US005102010A

United States Patent [19]

Osgar et al.

[11] Patent Number: 5,102,010

[45] Date of Patent: Apr. 7, 1992

[54] CONTAINER AND DISPENSING SYSTEM FOR LIQUID CHEMICALS

[75] Inventors: Michael L. Osgar, Eagan; Joshua P. Waldman, Edina, both of Minn.

[73] Assignee: NOW Technologies, Inc., Bloomington, Minn.

[21] Appl. No.: 426,513

[22] Filed: Oct. 20, 1989

Related U.S. Application Data

[63] Continuation of Ser. No. 156,011, Feb. 16, 1988, abandoned.

[51] Int. Cl.[5] ..... B65D 83/14

[52] U.S. Cl. ..... 222/1; 222/82; 222/105; 222/107; 222/399; 222/400.7; 222/541

[58] Field of Search ..... 222/82, 83, 81, 83.5, 222/88, 89, 91, 95, 105, 183, 386.5, 389, 131, 94, 152, 399, 400.7, 541-542, 92, 96, 182, 107, 185

[56] References Cited

U.S. PATENT DOCUMENTS

| | | | |
|---|---|---|---|
| 2,453,080 | 11/1948 | Shimp | 222/185 |
| 3,239,104 | 3/1966 | Scholle | 222/89 |
| 3,397,620 | 8/1968 | Skelton et al. | 92/24 |
| 3,467,283 | 9/1969 | Kinnavy | 222/95 |
| 3,777,925 | 12/1973 | Eckholm | 220/404 |
| 3,828,977 | 8/1974 | Borchert | 222/95 |
| 3,883,046 | 5/1975 | Thompson et al. | 222/95 |
| 3,945,534 | 3/1976 | Ady | 222/400.7 |
| 3,952,918 | 4/1976 | Poitras et al. | 222/82 |
| 4,073,159 | 2/1978 | Trippi | 222/389 |
| 4,089,443 | 5/1978 | Zrinyi | 222/386.5 |
| 4,147,278 | 4/1979 | Uhlig | 222/400.8 |
| 4,165,023 | 8/1979 | Schmit | 222/105 |
| 4,171,757 | 10/1979 | Diamond | 222/389 |
| 4,271,991 | 6/1981 | Diamond | 222/389 |
| 4,308,973 | 1/1982 | Irland | 220/454 |
| 4,330,066 | 5/1982 | Berliner | 215/1 C |
| 4,445,550 | 5/1984 | Davis et al. | 222/105 |
| 4,452,378 | 6/1984 | Christine | 222/107 |
| 4,457,455 | 7/1984 | Meshberg | 222/105 |
| 4,491,247 | 1/1985 | Nitchman et al. | 222/131 |
| 4,562,942 | 1/1986 | Diamond | 222/386.5 |
| 4,582,223 | 4/1986 | Kobe | 222/82 |
| 4,641,765 | 2/1987 | Diamond | 222/386.5 |
| 4,756,347 | 7/1988 | Hagan et al. | 222/400.7 |
| 4,804,065 | 2/1989 | Scragg | 222/94 |
| 4,892,230 | 1/1990 | Lynn, Jr. | 222/105 |

FOREIGN PATENT DOCUMENTS

| | | | |
|---|---|---|---|
| 8200780 | 3/1982 | PCT Int'l Appl. | 222/105 |
| 762567 | 11/1956 | United Kingdom . | |

*Primary Examiner*—Robert P. Olszewski
*Assistant Examiner*—Steve Reiss
*Attorney, Agent, or Firm*—Kinney & Lange

[57] ABSTRACT

A container for storage, transport and dispensing of liquid chemicals uses a collapsable thin film pouch which is sealed to a fitment and is positioned within a bottle or overpack. A retainer and cap hold the pouch and fitment in place within the bottle. The cap provides an inner seal and an outer seal which remain intact during shipping and storage. In use, the outer seal is removed and the container is connected to either a manual or an automated dispensing system which includes a valve probe which breaks the inner seal. In the manual system the bottle is inverted so that flow of liquid from the pouch is gravity assisted. In the automated system, the container is placed within a pressure vessel and air pressure is applied both to the outside of the bottle and also to the inside of the bottle to assist in collapsing the pouch and forcing the liquid out of the pouch. When empty, the container is removed from the manual or automated dispensing system and the cap and retainer are removed to allow removal and disposal of the pouch and fitment.

72 Claims, 18 Drawing Sheets

Fig. 1
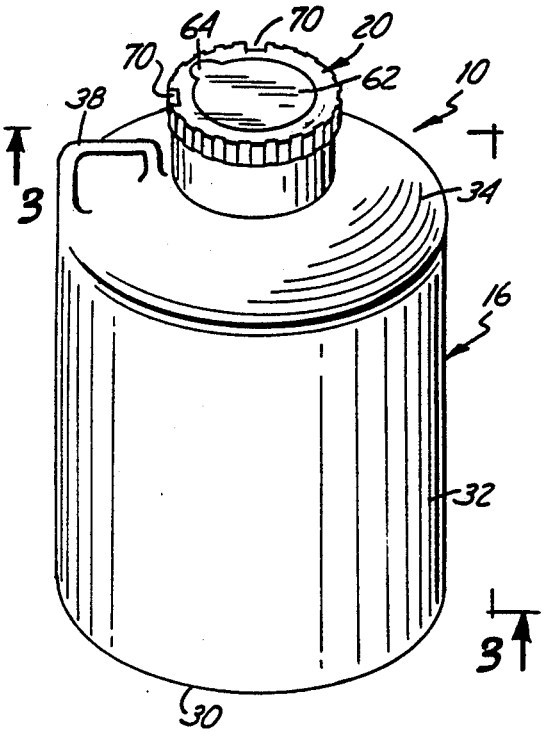
Fig. 2
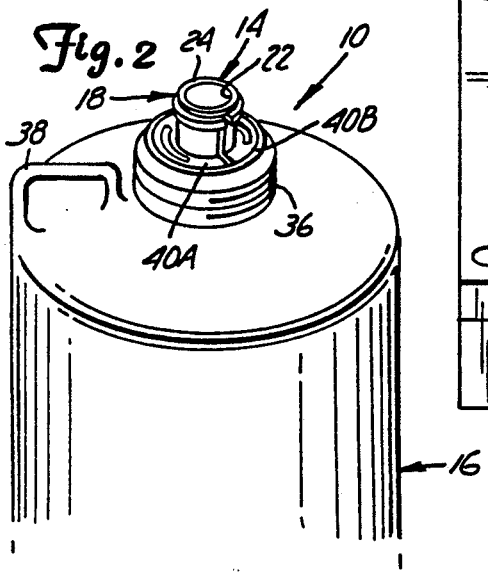
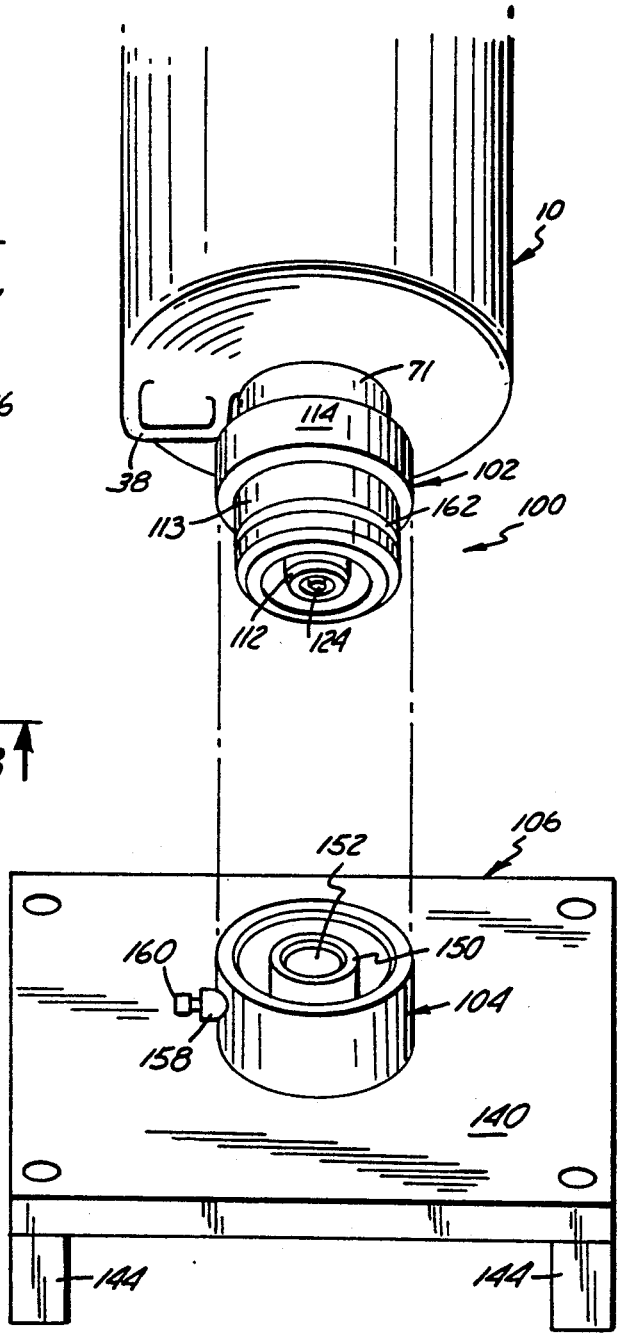
Fig. 9

10
38
64
48A
60
66
62
24
48B
68
71
52A
54A
22
46A
54B
52B
56
20
50A
26
50B
36
34
28
14
18
16
12
32
10
30

CONTAINER AND DISPENSING SYSTEM FOR LIQUID CHEMICALS

This is a continuation of application Ser. No. 07/156,011 filed on Feb. 16, 1989, abandoned as of the date of this application.

BACKGROUND OF THE INVENTION

1. Field of the Invention

The invention relates to containers for storage, transport and use of liquid chemicals including acids, solvents, bases, photo-resists, dopants, inorganics, organics, biological solutions, pharmaceuticals, and radioactive chemicals. In particular, the invention relates to a container which uses a disposable film pouch within a bottle or overpack, and to dispensing systems used in conjunction with this container.

2. Description of the Prior Art

Presently, the users of liquid chemicals have had a very limited choice of packaging, delivery, and disposal methods for those chemicals. One prior art system delivers chemicals from a bulk source, usually a 55 gallon drum, to the point of use. This type of delivery system, including the drums, piping, and automated delivery equipment, is very expensive, making it usable by only a small number of manufacturers whose volume is sufficient to justify the high cost.

A second, most widely-used alternative is to handle the liquid chemicals in bottles made of glass or polyethylene. This alternative, however, has several disadvantages. In particular, glass and polyethylene have been shown to contribute both particulate contamination and metal-ion extractables which significantly compromise the level of desired purity of liquid chemicals. In addition, the dispensing methods used with glass and polyethylene bottles also compromise the purity of the chemical contents. Manual decanting exposes chemicals to atmospheric contamination, and also can compromise the safety of the technicians handling the bottles. With glass bottles, there is also the danger of breakage; even slight abuse to the bottles can be very hazardous if breakage occurs. Disposal of empty bottles is also a major concern. Disposal typically requires triple rinsing, tagging, and crushing before sanitary disposal. This process is labor intensive and tedious.

A third alternative is the use of blow-molded fluoropolymer bottles. With this alternative, the manual handling of the bottle (as opposed to bulk delivery) is maintained, yet the fluoropolymer bottle provides inertness which is critical to maintaining the of the chemicals being handled. These-blow molded bottles, however, are very expensive and therefore have only been cost justified by the use of a returnable program in which the bottles are returned to the manufacturer for processing and reuse. A returnable program, however, presents numerous logistical problems for suppliers and users alike.

There is a continuing need for improved containers and systems for storage, transport and use of liquid chemicals. In particular, there is a continuing need for containers which are much lower in cost yet offer the handling characteristics of fluoropolymer bottles or of automated delivery systems.

SUMMARY OF THE INVENTION

The present invention is a container for liquid chemicals which includes an inert corrosion resistant plastic film pouch, a fitment sealed to the pouch for providing an opening through which the pouch can be filled and emptied, an outer bottle or overpack surrounding the pouch, and retaining means for engaging the fitment to hold the pouch and fitment within the bottle.

When the pouch has been filled with the liquid chemical, the container is capped with a cap which includes a break seal for closing the opening of the fitment.

The contents of the container can be dispensed in a number of different ways. In one preferred embodiment of the present invention, a dispensing closure is attached to the cap of the container and includes a probe which breaks the seal provided by the cap. The dispensing closure includes a valve which is normally closed to prevent flow of the liquid until the dispensing closure has been inserted into a dispensing receptacle. The engagement of the dispensing closure and the receptacle opens the valve, and allows flow of the liquid chemical out of the pouch, through the valve, and through an outlet to a metering or other liquid flow control device.

In another embodiment of the present invention, automated dispensing of the contents of the pouch are provided by a system which includes a pressure vessel into which the container is placed. Vent openings allow air to enter the region between the inner wall of the bottle and the pouch. The interior of the pressure vessel is pressurized, so that there is no pressure differential between the inside and outside of the bottle, but there is pressure being applied to the pouch which causes it to collapse as liquid is forced out of the pouch through the fitment and through a valve probe which has been inserted in the mouth of the fitment.

BRIEF DESCRIPTION OF THE DRAWINGS

FIG. 1 is a perspective view of a preferred embodiment of the container of the present invention.

FIG. 2 is a perspective view, similar to FIG. 1, with the cap of the container removed.

FIG. 9 is a perspective diagram illustrating a manual dispensing system used with the container of FIG. 1.

DETAILED DESCRIPTION OF THE PREFERRED EMBODIMENTS

1. The Container (FIGS. 1-8B)

Figure 3:
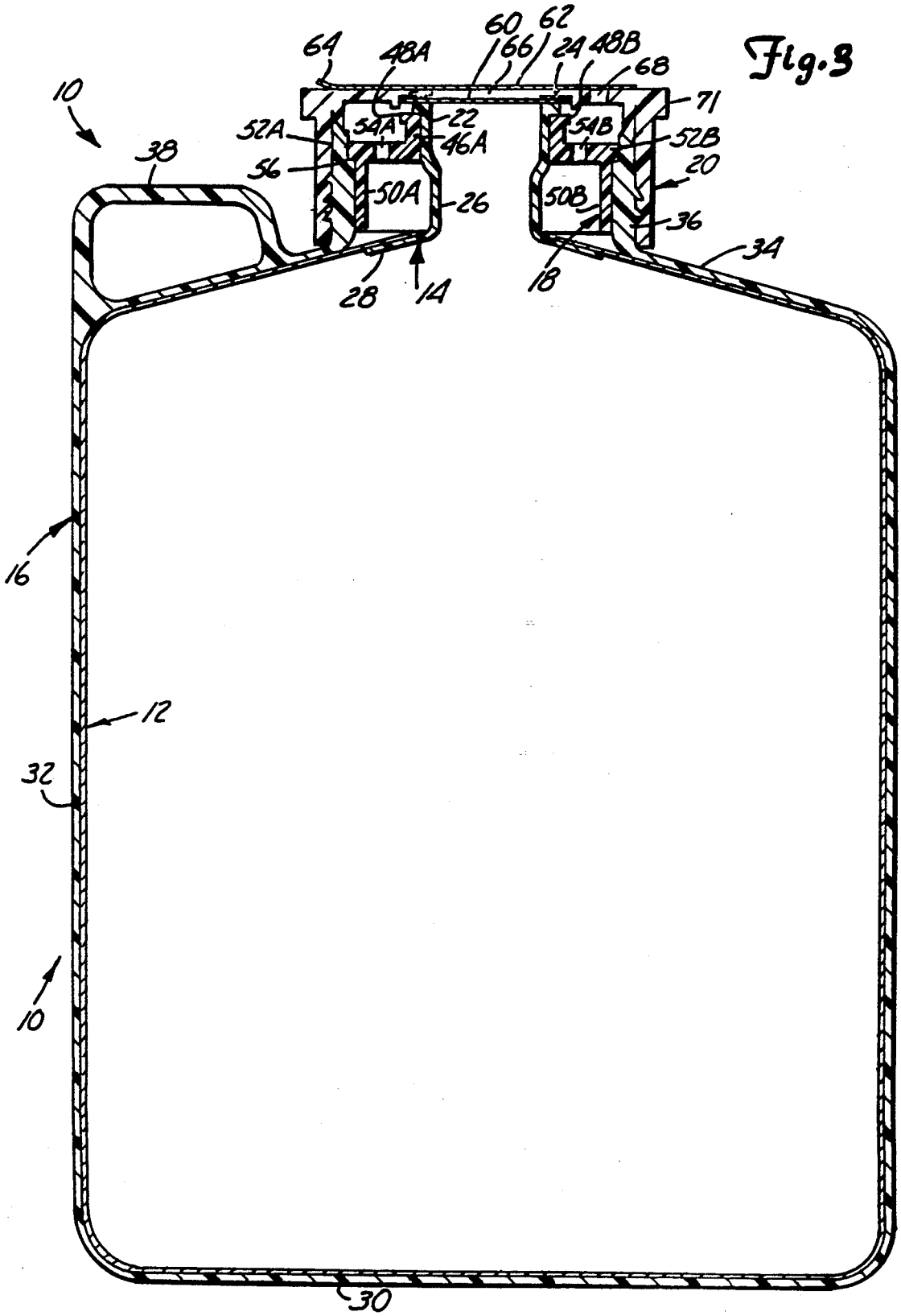
FIG. 3 is a sectional view along section 3—3 of FIG. 1.

FIGS. 1-6 illustrate a preferred embodiment of container 10, which includes five main components: inner pouch 12, fitment 14, outer bottle 16, retainer 18, and cap 20.

Figure 4A:
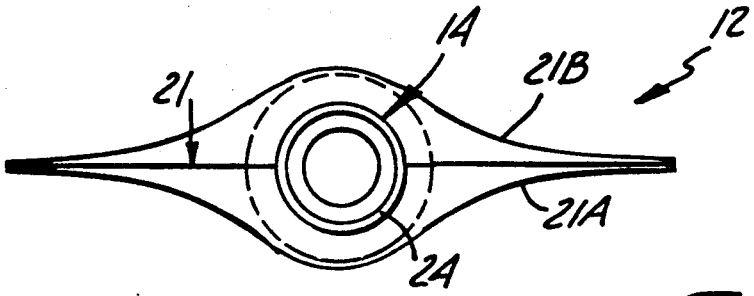
FIGS. 4A and 4B are top and side elevational views of the pouch and fitment of the container of FIG. 1–3.
Figure 4B:
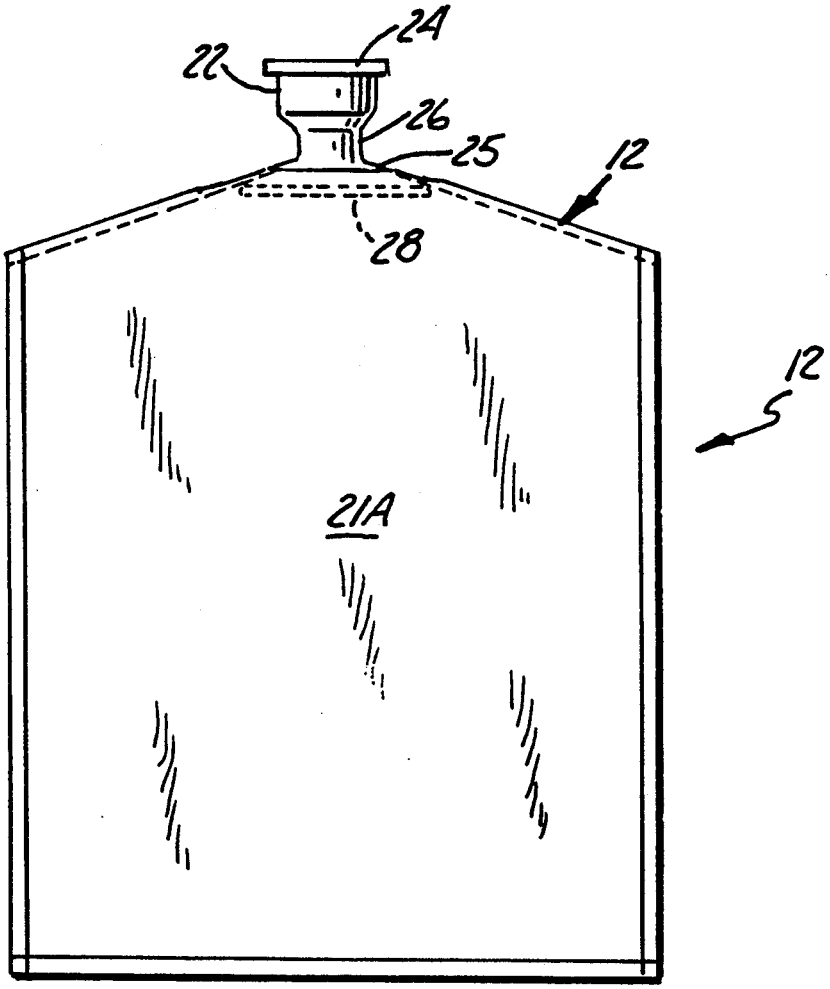

Pouch 12, which is best shown in FIGS. 3, 4A and 4B, is preferably constructed of a fluoropolymer film, such as polytetrafluoroethylene, in a one to twenty mil thickness range. A film sheet 21 is folded to form two identical opposing film sheets 21A and 21B. Heat seals 23A-23C around the outer edges of sheets 21A and 21B form pouch 12. Depending upon the fluid being packaged, additional film laminants such as nylon, mylar, or metal foil may be added to the layer of fluoropolymer film. For example, a reflective metal foil may be used on an outer surface of pouch 12 when the liquid chemical to be stored within pouch 12 is a photoresist or other photosensitive liquid.

As shown in FIGS. 4A and 4B, the heat sealed shape of pouch 12 is contoured to minimize stress at joints. The capacity of pouch 12 is preferably slightly larger than that of bottle (or overpack) 16.

Access to the interior of pouch 12 for filling and dispensing is gained through fitment 14, which extends through hole 25 in the top of sheet 21. Pouch 12 and fitment 14 are constructed of similar materials to allow for heat seal assembly. As shown in FIG. 3, fitment 14 includes a mouth 22 with a lip 24 at its upper end, an intermediate neck 26, and a lower shoulder or flange 28. Flange 28 is heat sealed by seal 29 to the upper edge of pouch 12 surrounding hole 25.

Outer bottle or overpack 16 provides the mechanical support and protection required by pouch 12 during filling, transport, handling, and dispensing. Bottle 16 is typically constructed of a plastic material such as polyethylene, although other materials including metal may also be used depending upon government regulatory specifications for handling of the particular liquid chemicals to be contained within container 10. Outer bottle 16 is a generally cylindrical closed vessel having a bottom 30, sidewalls 32, sloped top 34, externally threaded wide mouth 36, and integral handle 38. The sloped walls of top 34 are desirable because container 10 typically will be used in a manual or automated dispensing system in an inverted position. The sloped walls of top 34 ensure that fitment 14 is at the lower-most position when container 10 is inverted.

Figure 5B:
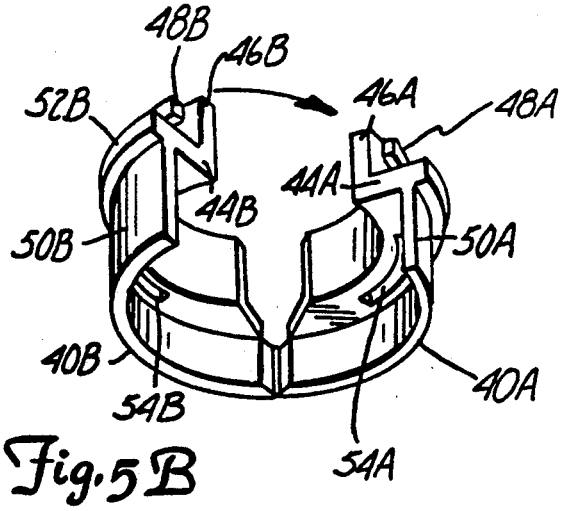
FIGS. 5A and 5B are perspective views of the retainer of container of FIGS. 1–3.
Figure 5A:
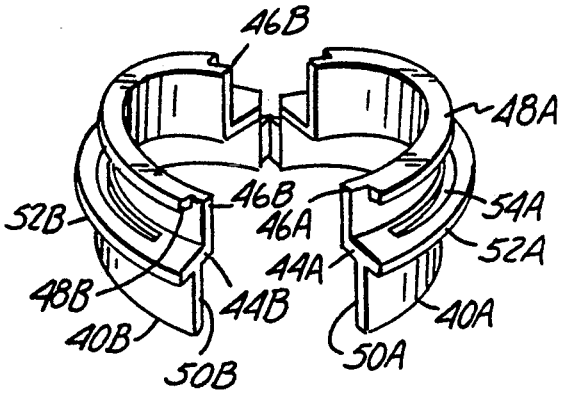

Retainer 18, which is best shown in FIGS. 5A and 5B, is a clam shell type ring containing a pair of semicircular segments 40A and 40B which are joined by living hinge 42. Each segment 40A, 40B includes generally horizontal portion 44A, 44B and upwardly projecting section 46A, 46B with upper flanges 48A, 48B, and downwardly projecting walls 50A, 50B. The intersection of walls 50A, 50B with horizontal sections 44A, 44B define a pair of flanges 52A, 52B. Within horizontal sections 44A, 44B are vent holes 54A, 54B.

As shown in FIG. 3, retainer 18 is placed around fitment 14 so that the top edges of upwardly projecting sections 46A and 46B engage the lower surface of flange 24 of fitment 14. Retainer 18 is placed within mouth 36 of bottle 16 so that walls 50A-50B are adjacent the inner walls of mouth 36 and flanges 52A-52B engage annular shoulder 56 near the top inner surface of mouth 36.

Flanges 48A, 48B provide a gripping surface by which retainer 18 can be pulled out of mouth 36 after pouch 12 is empty and after cap 20 has been removed.

Mouth 22 of fitment 14 is closed by break seal membrane 60, which is preferably a fluoropolymer film material. Membrane 60 is preferably scored to promote puncture when accessed by a proper dispensing connector (as will be described in more detail later.)

Cap 20 is preferably constructed of a plastic material such as polypropylene, and has internal threads for engaging the external threads of mouth 36 of bottle 16. Cap 20 is designed to be screwed down onto bottle 16 to a predetermined torque to ensure a liquid and air-tight seal between fitment 14 and membrane 60 and between cap 20 and bottle 16.

Figure 6:
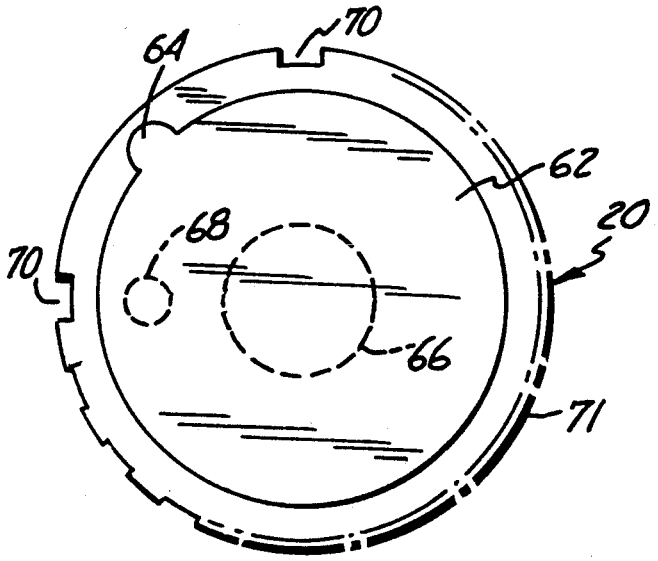
FIG. 6 is a top view of the cap of the container of FIG. 1.

Cap 20 also includes a tear-away outer seal, which in the embodiment shown in FIGS. 1, 3, and 6 is an adhesive backed film 62 with a pull tab 64. Film 62 covers central main port 66 of cap 20, as well as vent port 68. Film 62 remains in place, providing a back up seal for container 10, until the contents of container 10 are to be dispensed. At that time, film 62 is torn away by grasping and pulling up on pull tab 64. This exposes main port 66 and vent port 68, but membrane 60 is still in place to provide a seal until an appropriate dispensing device is attached to cap 20.

Vent port 68 and vent holes 54A and 54B provide a path for air to enter the interior of container 10 between pouch 12 and the walls of bottle 16. This permits air pressure to assist in collapsing bag 12 as liquid is dispensed.

In preferred embodiments of the present invention, cap 20 includes coding keys or slots 70 in flange 71 which uniquely designate the particular liquid chemical contained within pouch 12. These slots 70 mate with the particular dispensing system to ensure that only the proper containers will be connected to the dispensing system.

Figure 7:
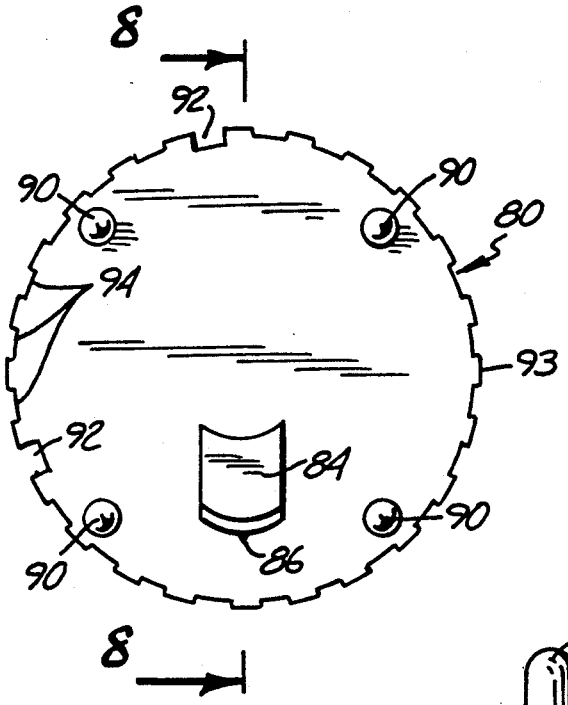
FIG. 7 is a top view of an alternative embodiment of the cap.
Figure 8A:
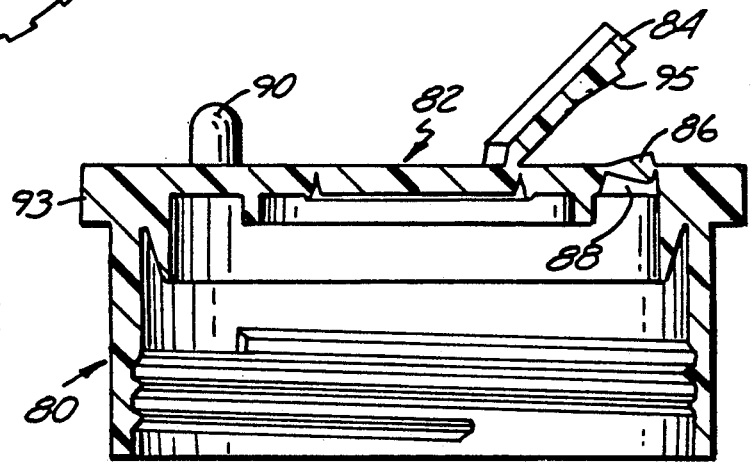
FIGS. 8A and 8B are sectional views, generally along section 8—8 of FIG. 7, showing the cap during shipping and during opening of a vent hole and removal of a tear-away seal, respectively.
Figure 8B:
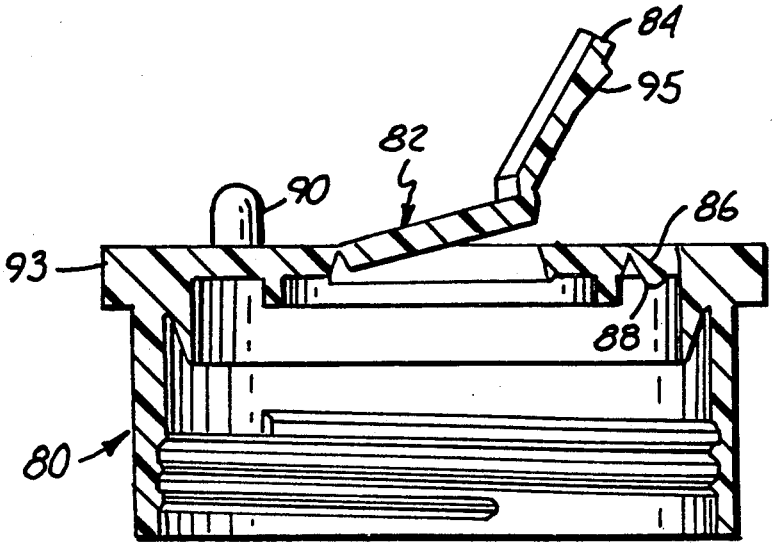

FIGS. 7, 8A and 8B illustrate an alternative embodiment of the cap for use in the container of the present invention. Cap 80 shown in FIGS. 7, 8A and 8B is a molded plastic cap, preferably of polypropylene which contains an integral tear away portion 82 and tear away tab 84. Knock out 86 is positioned generally below tab 84, and covers vent port 88.

Cap 80 has four upwardly projecting alignment pins 90 which are used for proper alignment of a dispensing mechanism over cap 80, and which also protect against accidental opening in the event bottle 16 and cap 80 are dropped. Also included are key coded slots 92 in flange 93, which identify the particular liquid chemical contained within the container, and thus prevent the container from being connected to the wrong dispensing system. Shallower slots 93 are circumferentially positioned in flange 93 for gripping and for allowing air to pass when a dispensing device is placed over cap 80.

To open the vent port 88, tab 84 is pushed downward so that ramp 95 engages knock out 86 and breaks the connection at one edge between knock out 86 and the remainder of cap 80 so that vent port 88 is open. The main passage is then removed by pulling up on tab 84 to break the connections between section 82 and the remainder of cap 80.

Container 10 of the present invention has significant advantages over the prior art containers for liquid chemicals. First, the portions of container 10 which contact the liquid chemicals (i.e. pouch 12 and fitment 14) are of materials such as fluoropolymers which are superior to conventional glass or polyethylene containers in terms of eliminating particle shedding and metal ion leeching.

Second, outer bottle 16, which preferably is made of a plastic or metal, provides a construction which is more rugged than prior art glass containers.

Third, by the use of fluoropolymers for all of the parts (pouch 12, fitment 14 and membrane 60) actually contacting the liquid chemicals, container 10 is less permeable than polyethylene containers.

Fourth, by making the pouch 12 and fitment 14 of fluoropolymers, but providing the mechanical strength and protection by a polyethylene or metal outer bottle 16, the overall cost of the container 10 is less than an all fluoropolymer blow-molded container, while still offering the advantages of fluoropolymer materials.

Fifth, precleaning of the wettable surfaces of pouch 12 is facilitated before heat sealing while the flat fluoropolymer film 21 which forms pouch 12 is being unrolled.

Sixth, pouch 12 is preferably evacuated prior to filling, which allows for a sealed connection during filling. This eliminates venting of displaced air, which benefits the maintenance of chemical purity of the liquid chemicals being delivered to the pouch. Alternatively, pouch 12 can be filled with nitrogen immediately upon manufacture and leak testing, and the nitrogen can be maintained in pouch 12 until filling with the liquid chemicals.

Seventh, disposal after use does not require destruction of the entire container. Instead, it merely requires grasping flanges 48A, 48B of retainer 18 and pulling retainer 18, fitment 14 and pouch 12 out through mouth 36 of bottle 16. Disposal then merely involves collasped pouch 12 and fitment 14. Retainer 18 and bottle 16 can either be reused, or can be disposed of without elaborate cleaning procedures since they have not been in contact with liquid chemicals.

Eighth, container 10, with cap 20, provides two seals, including break seal or membrane 60 which is penetrated only when properly used in conjunction with a dispensing valve. In addition, cap 20 also seals to bottle 16. This ensures against atmospheric contamination of the contents during shipping and storage.

Ninth, the liquid chemical is actually "double contained," i.e. within both pouch 12 and bottle 16, which adds to safety in handling and shipping.

With container 10 of the present invention, dispensing can be accomplished using several different techniques. The container can simply be uncapped by removing cap 20 (or cap 80) and then manually inverted for decanting. Alternatively, cap 20 (or 80) can be removed and a tube inserted through fitment 14 into pouch 12, and the contents can be drawn out by use of a pump.

Still another technique for dispensing the contents of container 10 uses a manual dispensing valve assembly to which container 10 is connected. This manual system which is illustrated in FIGS. 9-12 includes a valve assembly which is connected to the container, and a platform which supports the container in an inverted position for gravity-assisted dispensing.

Container 10 can also be advantageously used with an automated system like the one shown in FIGS. 13-17, in which container 10 is placed in a pressure vessel and a pressurized gas is applied to the exterior of pouch 12 to squeeze the contents out of pouch 12 through a mating connection and dispensing line.

In the following portions of the specification, manual and automated systems for use with container 10 will be described in further detail. In all of these systems, the cap 20 or 80 of container 10 remains in place, so that the user does not have to risk direct contact with the contents of pouch 12. In addition, only fluoropolymer parts come in contact with the liquid chemical so that contamination during dispensing is minimized.

2. Manual Dispensing Systems (FIGS. 9-12)

Figure 10:
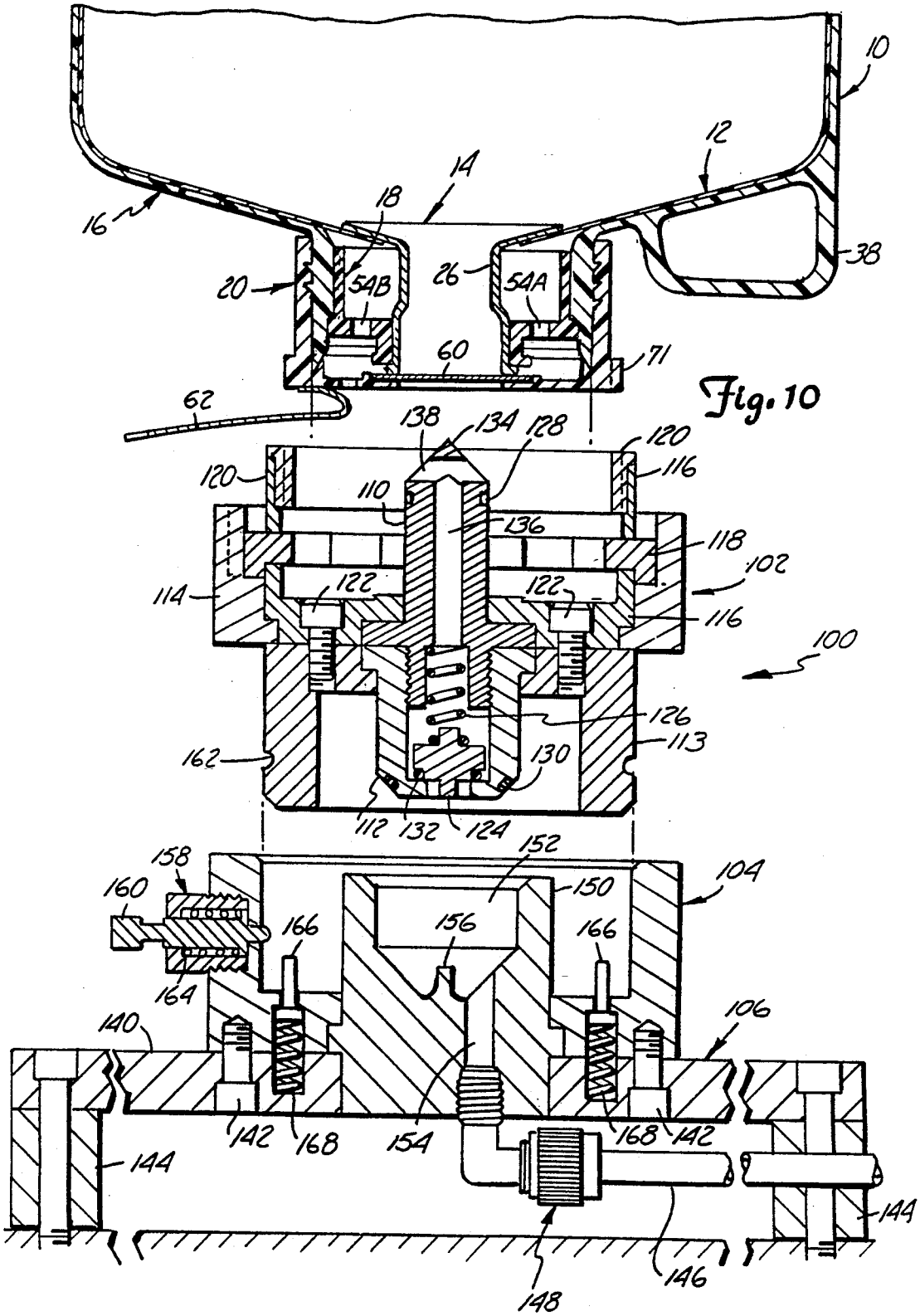
FIG. 10 is an exploded sectional view of the manual dispensing system of FIG. 9.
Figure 11:
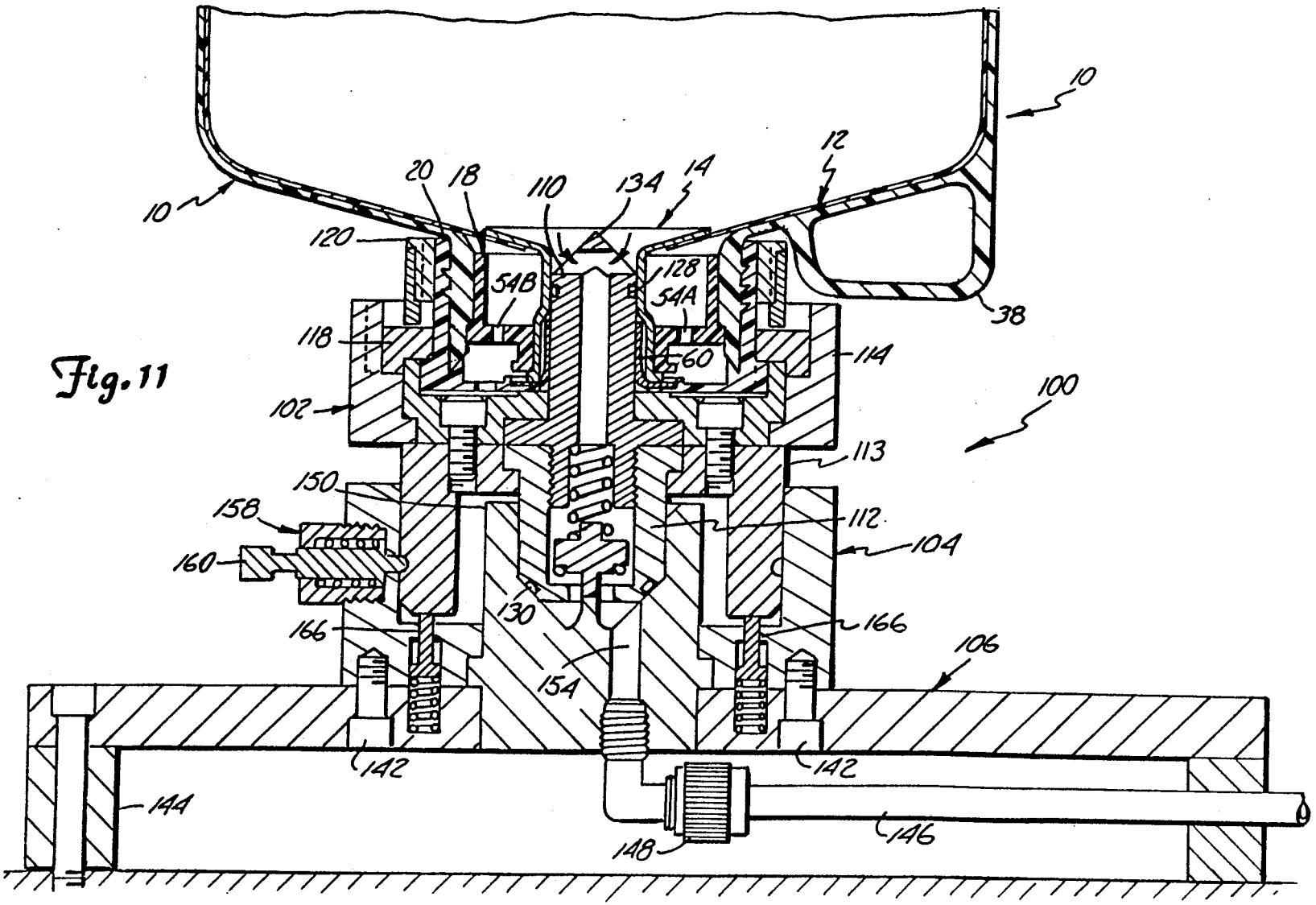
FIG. 11 is a sectional view of the manual dispensing system of FIG. 9 showing the system in operation.

FIGS. 9-11 illustrate one preferred embodiment of a manual dispensing system 100 which includes male dispensing closure 102, female receptacle 104, and base 106. Male dispensing closure 102 is first fitted over cap 20 while container 10 is in an upright position, and the combination of container 10 and dispensing closure 102 are then inverted (as shown in FIG. 9) and inserted into female receptacle 104 (as shown in FIG. 11).

As best shown in FIG. 10, dispensing closure 102 includes probe 110, check valve body 112, check valve housing 113, lock ring 114, key code cover 116, locking tabs 118, key tabs 120, bolts 122, check valve plunger 124, spring 126, and O-rings 128, 130, and 132. Key tabs 120, which are carried at the outer end of key code cover 116, mate with key code slots 70 of cover 20 to ensure that dispensing system 100 is the proper system for use with container 10. Once outer flange 71 of cover 20 has cleared key tabs 120, it passes four circumferentially spaced locking tabs 118, and is seated against key code cover 116. Lock ring 114 is rotatable to move the locking tabs 118 so that, once flange 71 is past locking tabs 118, it cannot be removed.

As dispensing closure 102 is being inserted over cap 20, pointed end 134 of probe 110 breaks membrane 60. As probe 110 moves into fitment 14, O-ring 128 provides a seal between the inner wall of neck 26 of fitment 14 and the outer wall of probe 110.

Probe 110 has a central bore 136 which is connected at one end to inlet passage 138 and at its opposite end to the interior of check valve body 112. When probe 110 is inserted into fitment 14, a fluid flow passage is established from the interior of pouch 12 through passage 138 and bore 136 to the interior of check valve 112. Check valve body 124, however, is normally seated against check valve body 112, and O-ring 132 seals the outlet of check valve body 112 so that no liquid is dispensed even when dispensing closure 102 is inserted over cap 20 and container 10 is inverted.

Female receptacle 104 is attached to top plate 140 of base 106 by screws 142. Base 106 also includes standoffs 144 to provide clearance beneath plate 140 for outlet tubing 146 and fitting 148.

Mounted within female receptacle 104 is manifold 150. Manifold 150 contains a cavity 152 for receiving check valve body 112. At the bottom of cavity 152 is outlet passage 154 and protrusion 156. As container 10 and dispensing closure 102 are lowered over base 106, valve body 112 is inserted into cavity 152, while check valve housing 113 is received within female receptacle 104. O-ring 130 forms a seal between check valve body 112 and manifold 150, while protrusion 156 pushes upward against check valve plunger 124 to unseat plunger 124 and allow flow of liquid from pouch 12 to outlet passage 154, and then through fitting 148 to outlet tubing 146.

Spring loaded plunger assembly 158 is mounted on the side wall of female receptacle 104. The distal end of plunger 160 nests in annular grove 162 of check valve housing 113. To remove container 10 and dispensing closure 102 from female receptacle 104, plunger 160 must first be pulled back against the bias force of spring 164.

Spring loaded pins 166 are mounted vertically in the bottom of receptacle 104 and press upward against the bottom surface of check valve housing 113. Bias springs 168 apply a force which urges pins 166 upward. When plunger 160 is pulled back to release dispensing closure 102 from receptacle 104, springs 168 and pins 166 provide an automatic force to displace closure 102 vertically upward to facilitate manual disengagement. This upward force also disengages check valve plunger 124 from protrusion 156 so that plunger 124 and O-ring 132 are seated against check valve body 112 in preparation for manual removal of container 10 and closure 102 from receptacle 104. Once the operator unlocks spring loaded plunger 158, container 10 and dispensing closure 102 can be removed with two hands without the chance of residual leakage. The empty container 10 is then set upright and dispensing closure 102 is removed for connection to the next full container.

Figure 12:
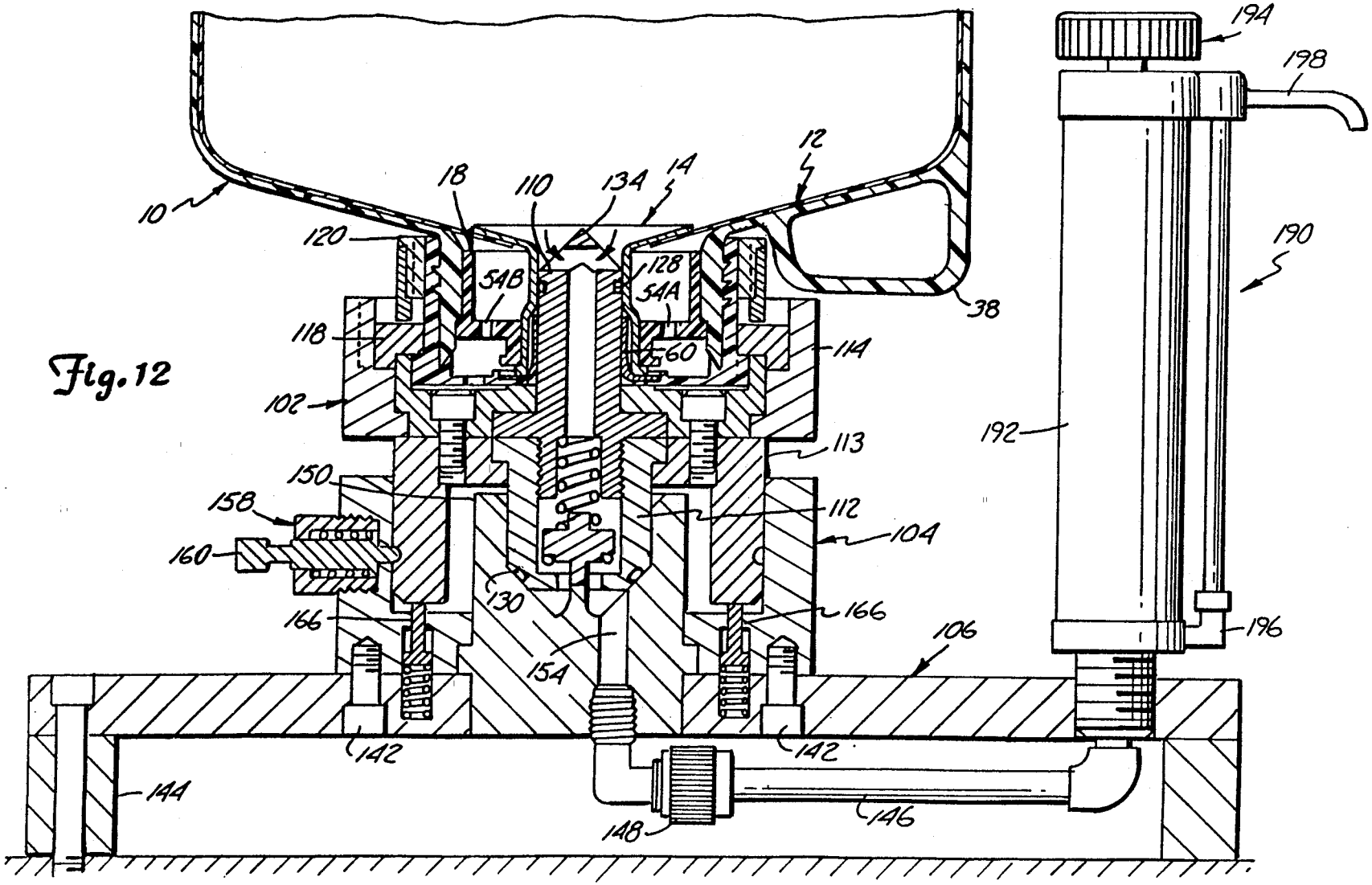
FIG. 12 is a sectional view of another embodiment of a manual dispensing system which includes a metering pump.

FIG. 12 shows another embodiment of the manual dispensing system which is generally similar to the embodiment shown in FIGS. 9-11. In FIG. 12, elements which are similar to those of the embodiment of FIGS. 9-11 are designated with similar reference characters.

The primary difference between the embodiment of FIG. 12 and the embodiment of FIGS. 9-11 is that the embodiment of FIG. 12 incorporates metering pump 190, which is supported on base 106 and which is connected to outlet to 146. Metering pump 190, which preferably uses only fluoropolymer material for those parts which contact the liquid chemical, contains a graduated cylinder 192, plunger 194, outlet 196, and discharge tube 198. When plunger 194 is pulled upward, liquid from container 10 is drawn through outlet tube 146 and through an inlet check valve (not shown) into the interior of cylinder 192. In preferred embodiments, cylinder 192 is graduated, so that the user can select the distance by which plunger 194 is moved upward and thus select the amount of liquid to be dispensed. When plunger 194 is then moved downwardly, the inlet check valve closes and liquid is forced out through an outlet check valve (not shown), outlet 196 and discharge tube 198. The inclusion of metering pump 190 in the dispensing system of the present invention provides a convenient, safe, and accurate way of dispensing measured quantities of a liquid chemical without the need for removing the cap from the container and without the need for expensive pumps (which generate particles which can contaminate the liquid), or the need for dip tubes which extend inside the open container and which are messy and can add to contamination due to excessive handling.

3. Automated Dispensing Systems (FIGS. 13-17)

Figure 13:
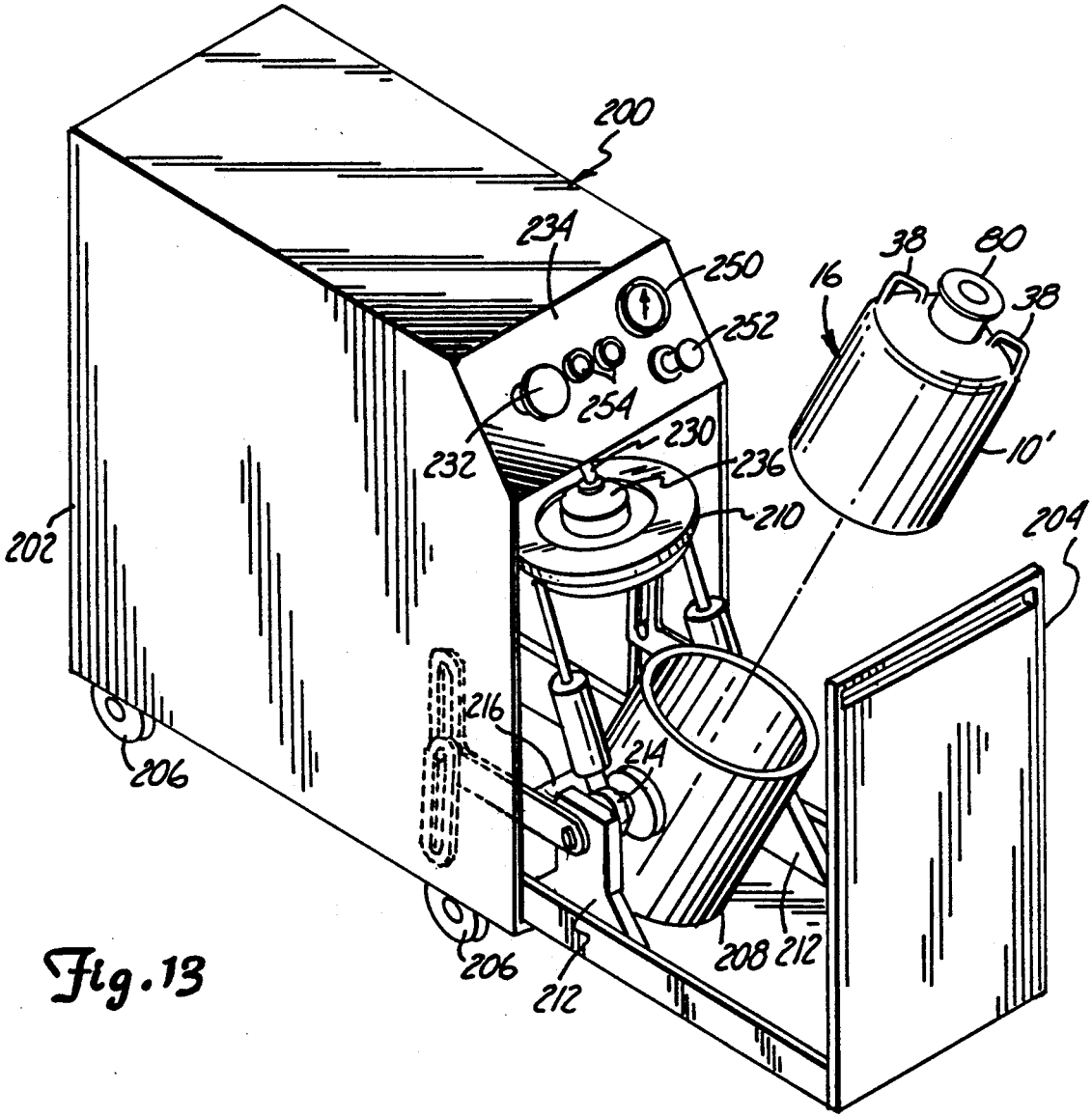
FIG. 13 is a perspective view of an automated dispensing system used with the container of the present invention.

FIG. 13 is a perspective view of automated dispensing system 200, which is used in conjunction with container 10' of the present invention. Container 10' is generally similar to container 10 shown in the preceding figures, except that it has two handles 38, and uses cap 80 (which is shown in FIGS. 7, 8A, and 8B).

Automated dispensing system 200 includes a main housing 202 with a roller drawer 204, which is shown in FIG. 13 in its open position. Both housing 202 and drawer 204 are supported by wheels 206, so that dispensing system 200 can be moved from location to location as needed.

Container 10' is placed within a pressure vessel formed by pressure canister 208 and cover 210. Canister 208 is pivotally supported by a pair of brackets 212 which are positioned on opposite sides of canister 208 and are attached to drawer 204. Shafts 214 extend outwardly from opposite sides of canister 208 and are pivotally mounted in and extend through upper ends of brackets 212.

Figure 14A:
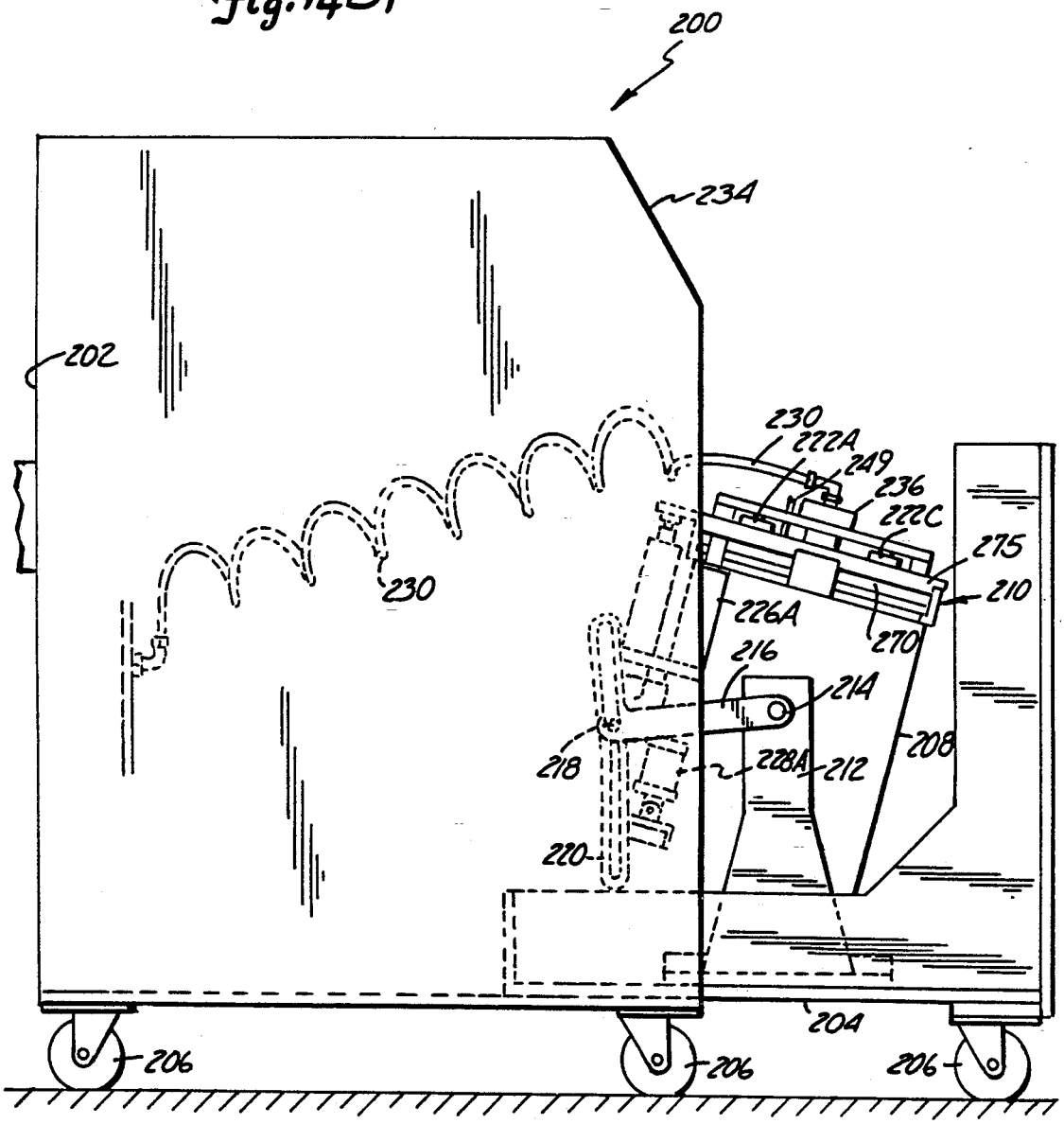
FIG. 14A and 14B are side views showing a pressure vessel and drawer of the system of FIG. 13 in two different positions.
Figure 14B:
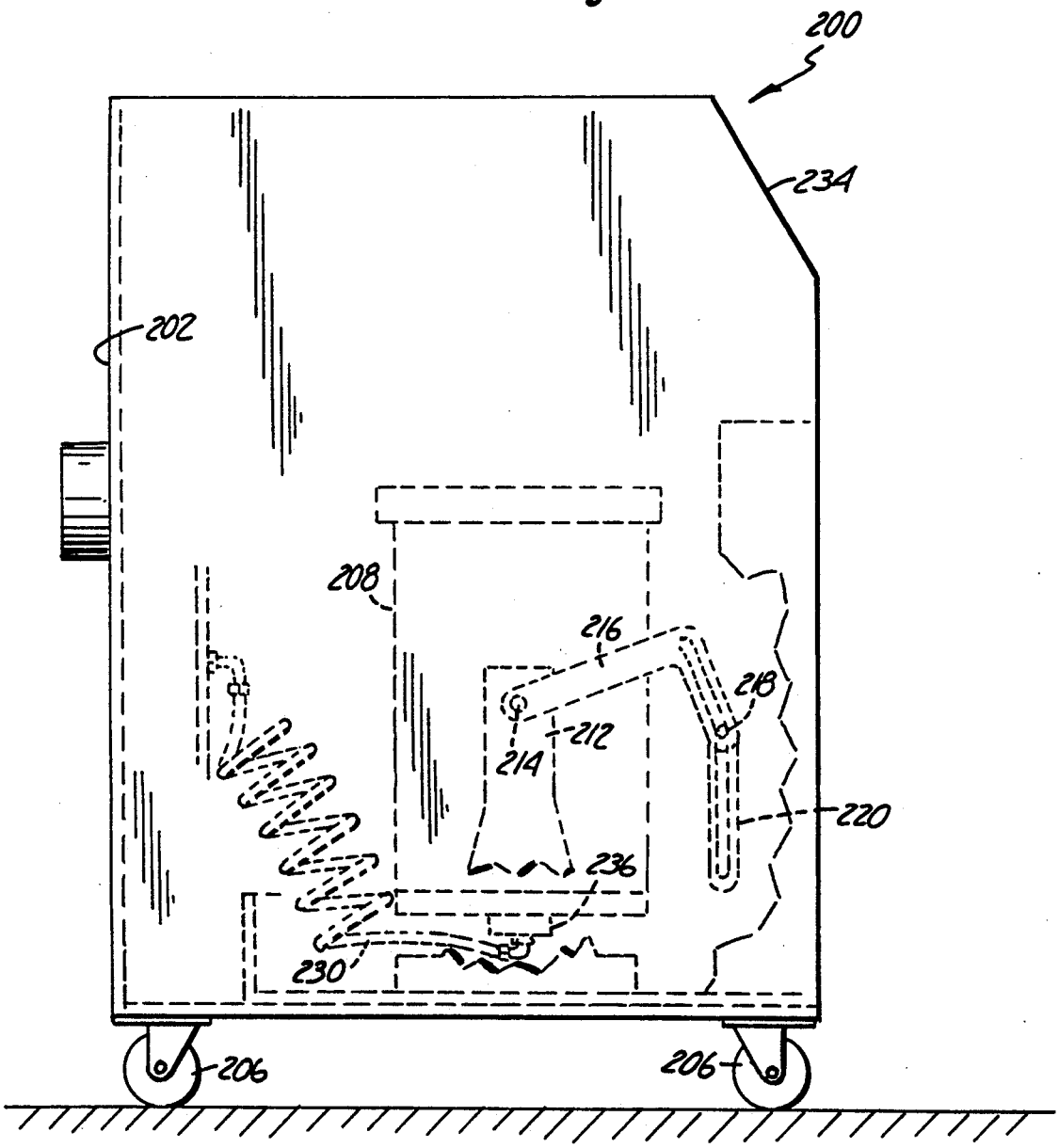
Figure 14C:
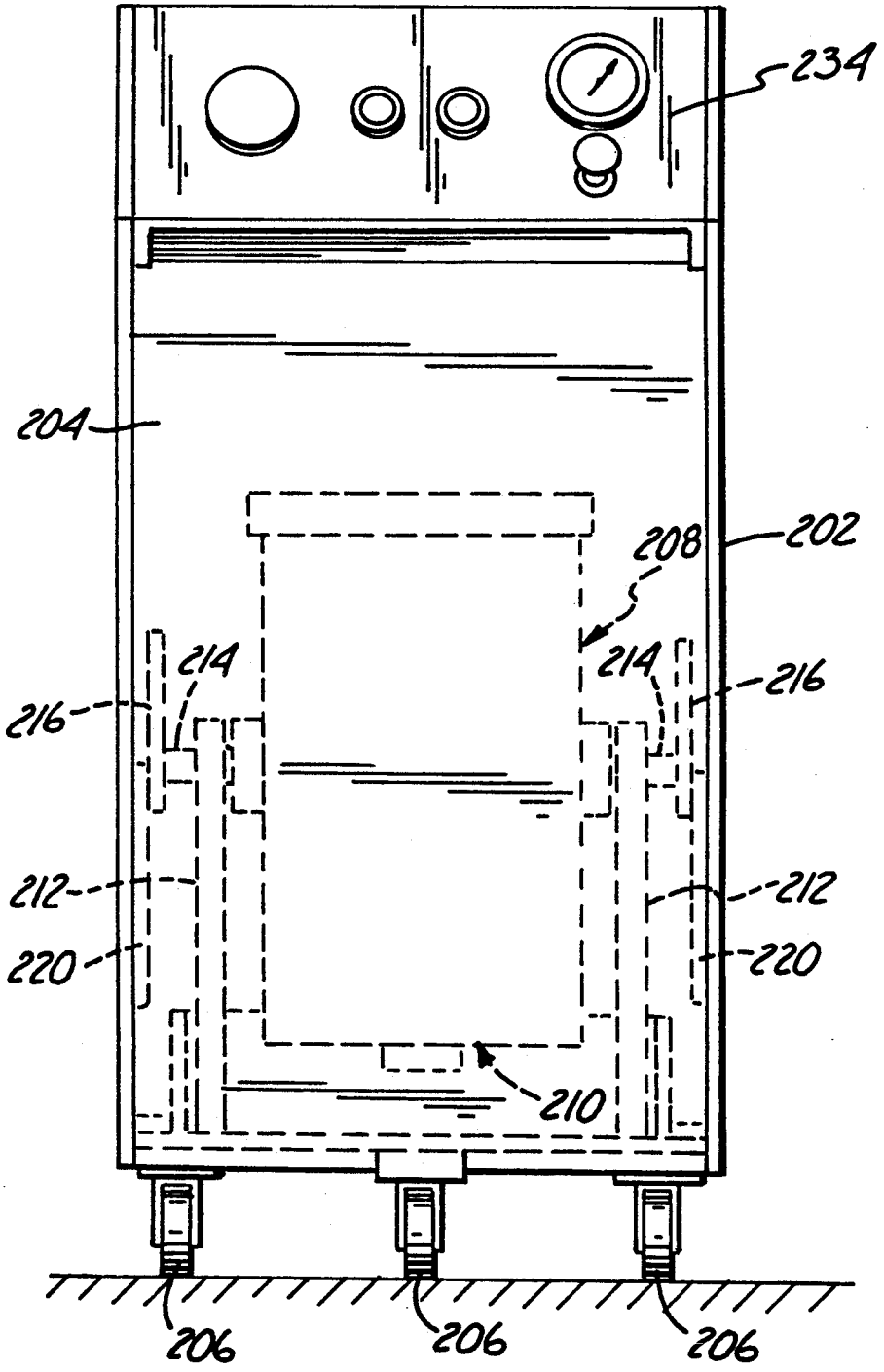
FIG. 14C is a front view of the system of FIG. 13.

A linkage formed by track arms 216, cam followers 218, and slides 220 are connected to shafts 214 to pivot canister 208 from the generally upright position shown in FIG. 13 and in FIG. 14A (when drawer 204 is open) to an inverted position shown in FIGS. 14B and 14C (when drawer 204 is closed).

The opening and closing of cover 210 over canister 208 is controlled by cover locking air cylinders 222A-222D, cover lift cylinders 224, 226A and 226B, and cover tilt cylinders 228A and 228B. When cover 210 is in place and sealed over canister 208, a fluid path through cover 210 is established between flexible conduit 230 and container 10', which is within the sealed pressure vessel.

Figure 15A:
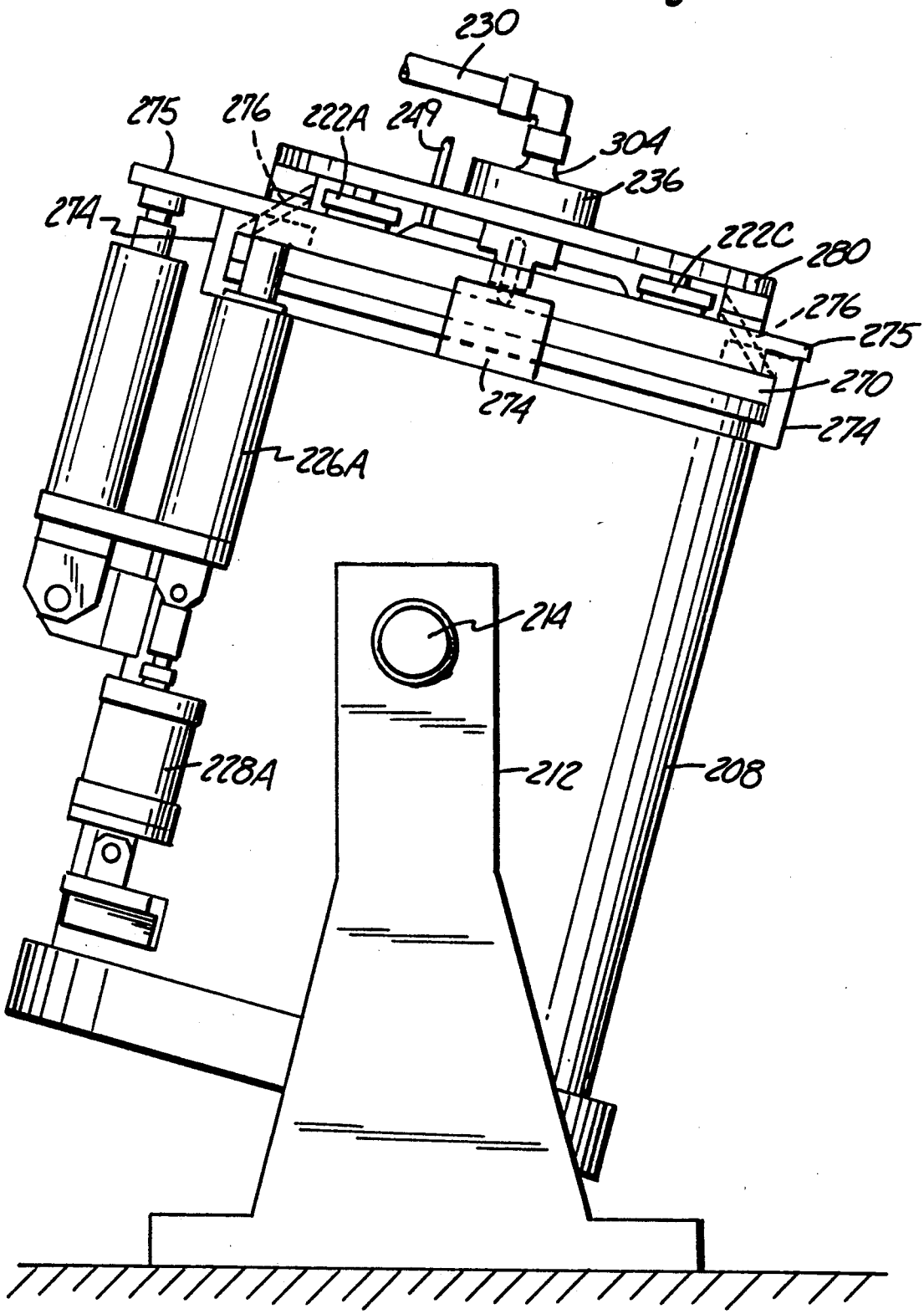
FIGS. 15A, 15B and 15C are side views showing the vessel cover in three different positions.
Figure 15B:
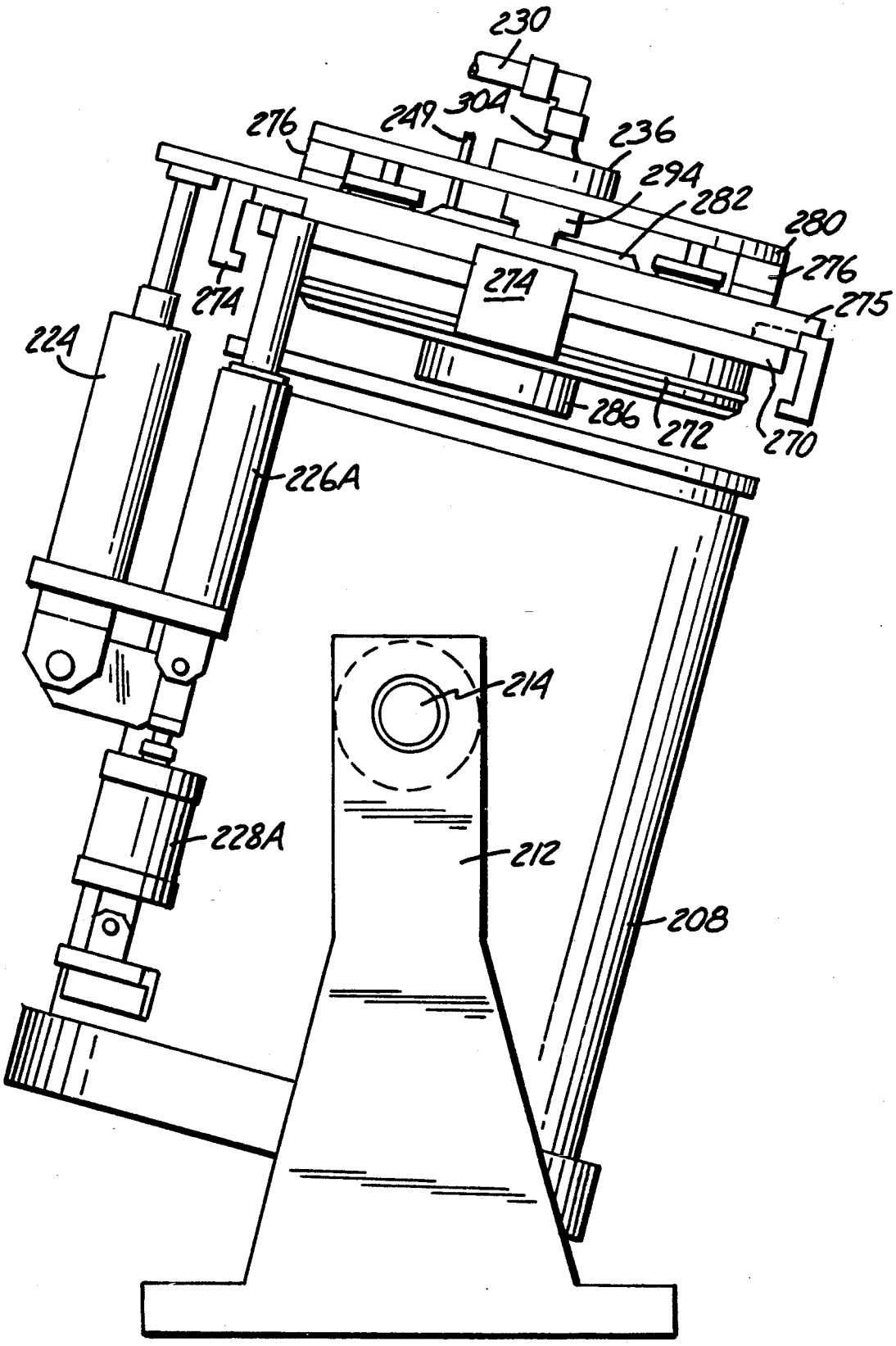
Figure 15C:
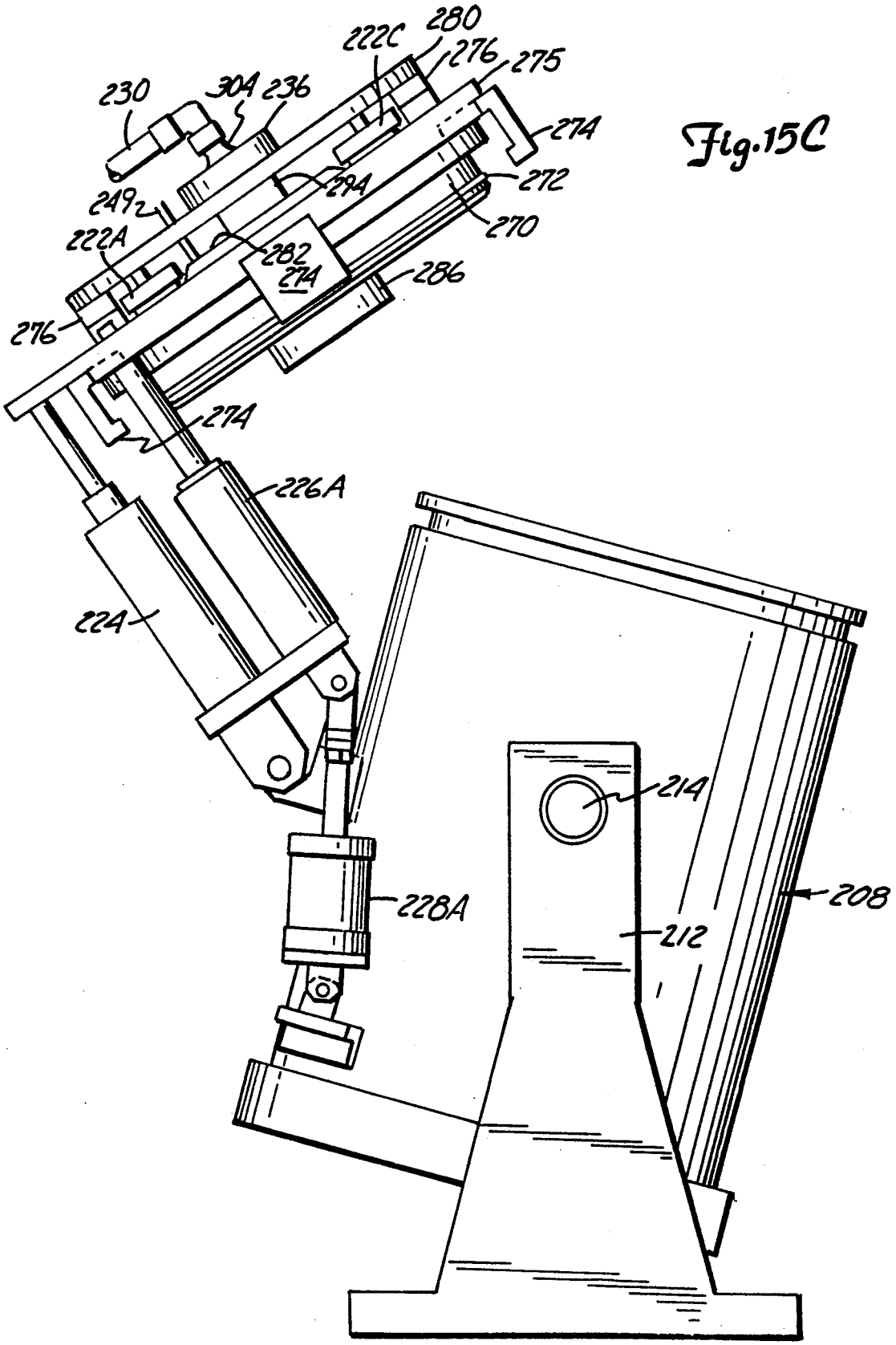
Figure 16A:
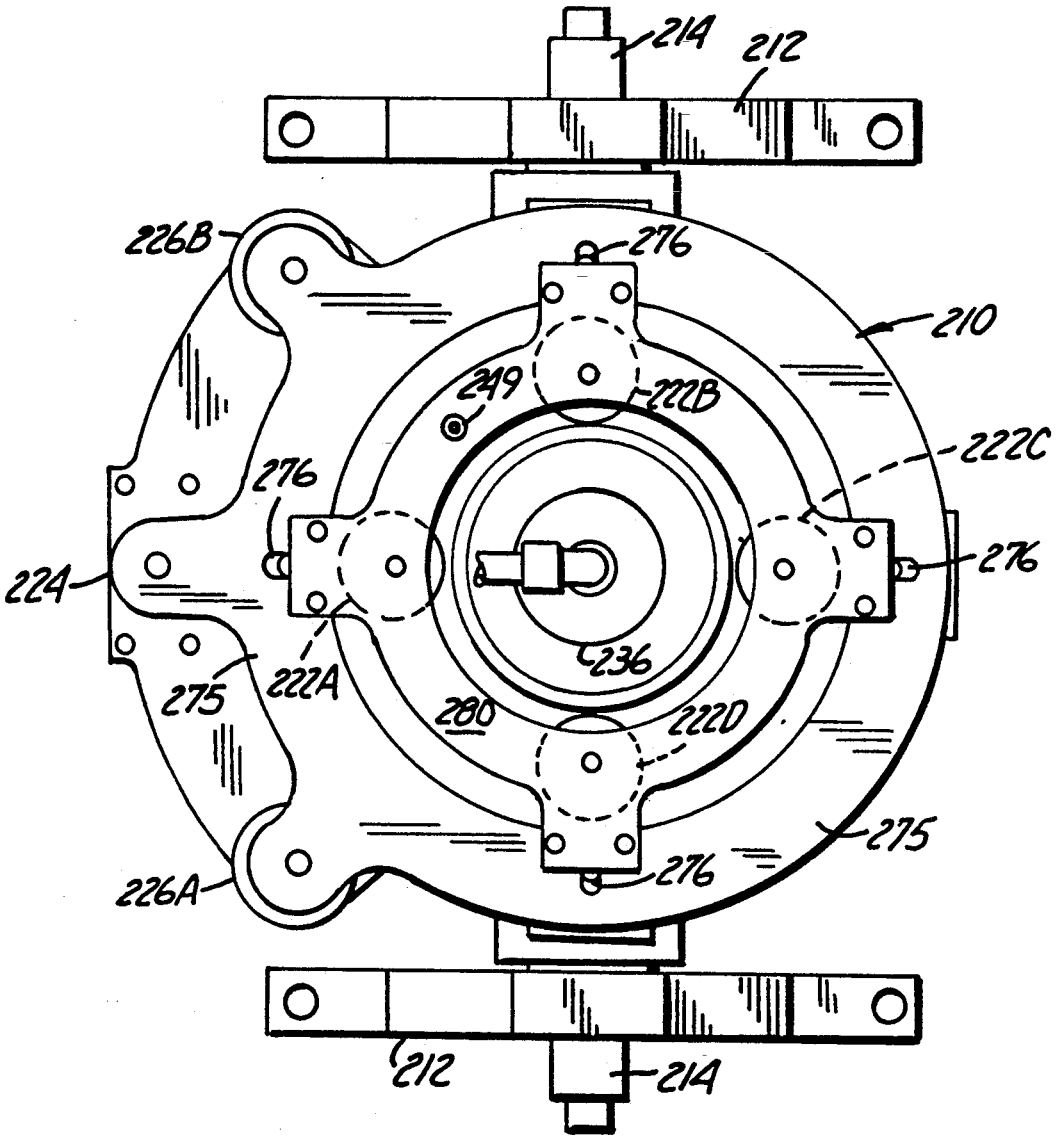
FIGS. 16A and 16B are top and rear views of the pressure vessel.
Figure 16B:
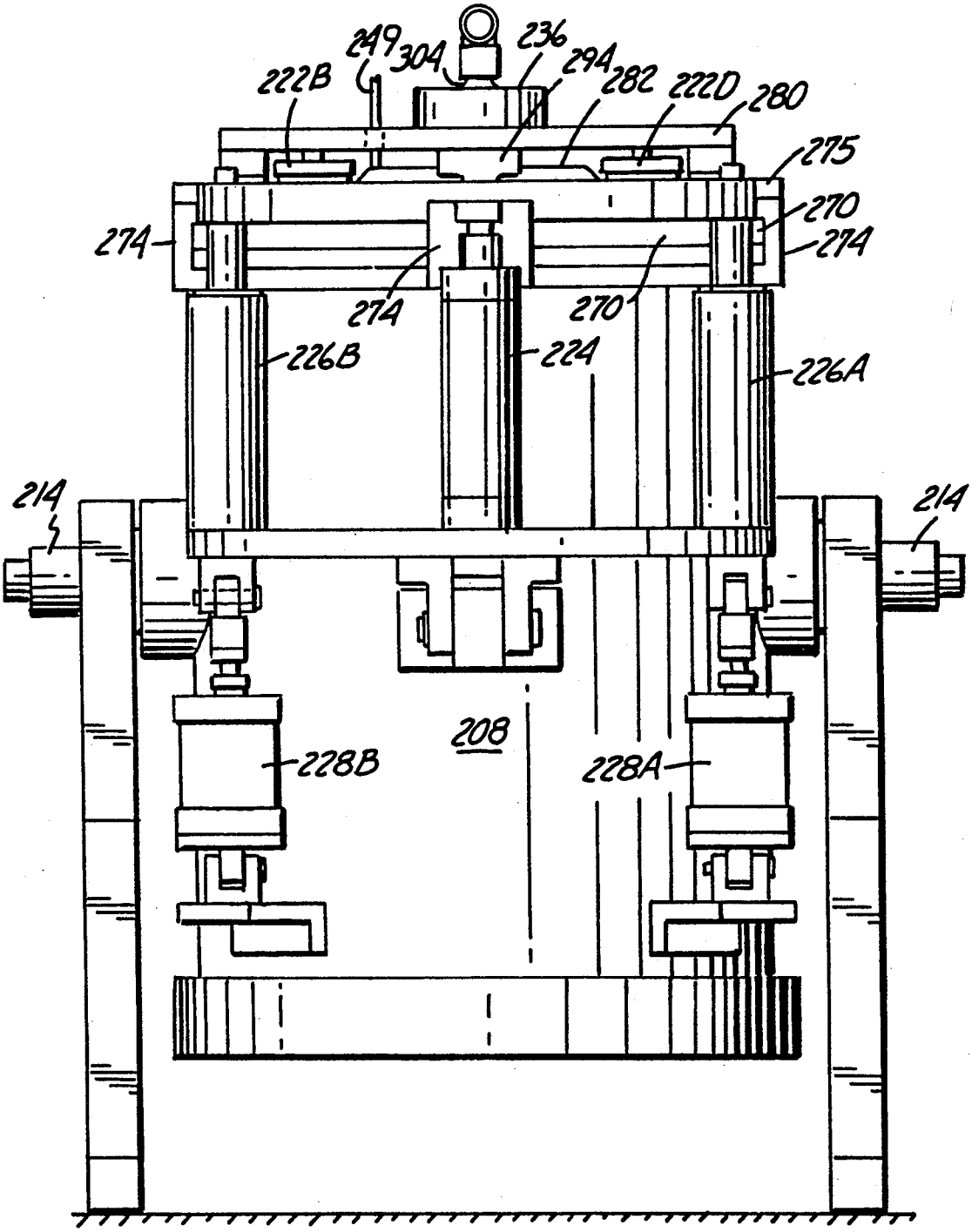

To load a fresh container 10' into dispensing system 200, roller drawer 204 is pulled out. Selector switch 232 on operator panel 234 is then turned to the "open" position. At this point, air cylinders 222A-222D are actuated to release the locking mechanism of cover 210, and cylinders 224, 226A and 226B raise cover 210 up as best illustrated by FIGS. 15A and 15B. Tilt cylinders 228A and 228B then tilt cover 210 back, as shown in FIG. 15C to allow access to the interior of canister 208.

Tear-away tab 84 cap 80 on the fresh chemical container is removed, thereby exposing a break seal membrane and opening vent hole 88 of cover 80. Container 10' is then manually lifted and dropped into canister 208.

The operator then turns selector switch 232 to the "load" position. Cylinders 228A and 228B tilt cover 210 directly back above the canister 208. The operator then manually pushes down on key coded knob 236 located on canister cover 210 until keycode cone 286 (shown in FIG. 17) comes in contact with cap 80. Knob 236 is then rotated until cone 286 becomes keyed with the key coded slots of cap 80. Due to the special design of the key code engagement mechanism (which will be described in more detail later with reference to FIG. 17) rotation of knob 236 is not transferred to probe 238 and conduit 230.

Selector switch 232 is then turned to the "closed" position in which air cylinders 224, 226A and 226B lower cover 210 into position. At the same time, cylinders 222A-222D on cover 210 actuate to open the clamps for final positioning on canister 208. As cover 210 comes down onto canister 208, probe 238 (FIG. 17) penetrates the break seal membrane 60 of container 10' and seals the inside neck 26 of fitment 14. Once cover 210 is completely lowered, pressure is automatically removed from the clamp actuating cylinders 222A-222D, which allows them to lock cover 210 in place.

The operator then closes drawer 204, which through the linkage formed by track arms 216, cam followers 218, and slides 220 on opposite sides of canister 208 rotates canister 208 to an inverted position. Canister 208 is shown in two different positions in FIGS. 14A and 14B, representing a "drawer open" and a "drawer closed" position.

Once drawer 204 is fully closed, selector switch 232 is turned to the "pressure" position. This allows compressed air to enter canister 208 through air line 249 and to enter the space between the inner walls of bottle 16 and pouch 12. In this way, air pressure is applied to both sides of the walls of bottle 16, so that bottle 16 does not have a pressure gradient applied to it.

A pressure gauge 250 and regulator 252 on operator panel 234 allow the operator to adjust the air pressure being applied to pouch 12. The introduction of compressed air into canister 208 only occurs if dispense button 254 on operator panel 234 is depressed or if an external electrical signal is provided to dispensing system 200. Under a normal non-dispensing mode, air pressure is not maintained in canister 208.

In a preferred embodiment of the present invention, an air flow switch (not shown) senses flow of compressed air into canister 208 during dispensing. As the compressed air enters canister 208, the liquid within pouch 12 is squeezed out of container 10. When pouch 12 is empty, the air flow stops due to the total displacement of liquid by the air in canister 208. The flow switch senses this lack of flow and sends a signal to an alarm which alerts the operator to change bottles.

In the event of an air or electrical failure, the chemical contents of container 10' will not leak out of canister 208, even when drawer 204 is closed and canister 208 is inverted. Cover 210 will remain tightly locked due to the clamping mechanism, in which air pressure to cylinders 222A-222D is required in order to unlock cover 210 from canister 208.

Another safety feature of dispensing system 200 provides automatic venting of pressure should the operator attempt to pull out drawer 204 during dispensing. Similarly, if drawer 204 is not fully closed, air pressure cannot be introduced into canister 208. In preferred embodiments of the present invention, interlock circuitry also prevents cover 210 from being removed from canister 208 unless the air pressure within canister 208 has been completely vented and canister 208 is in the upright position shown in FIGS. 13 and 14A.

Figure 17:
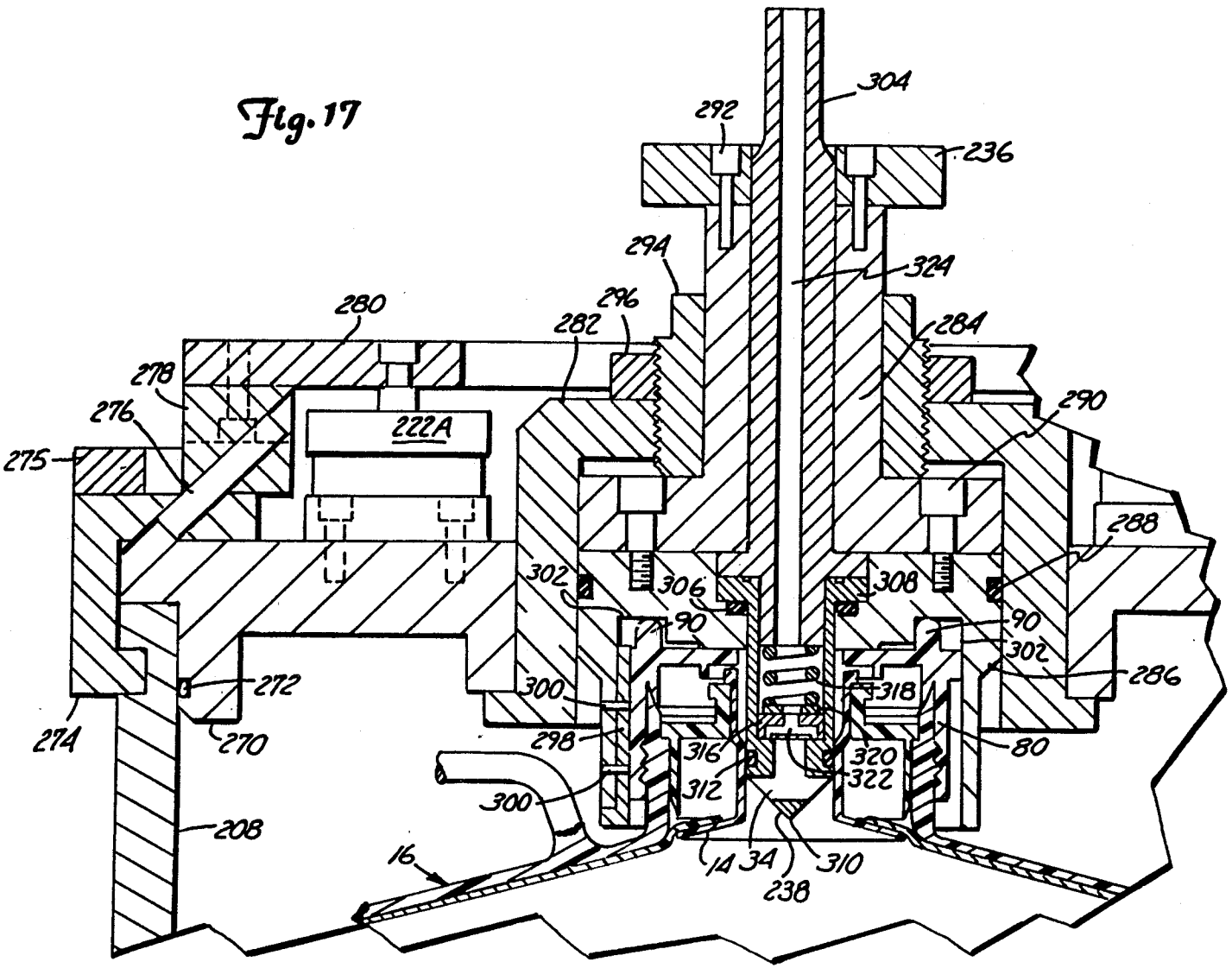
FIG. 17 is a sectional view along section 17—17 of FIG. 16A showing the dispensing valve mechanism of the automated system of FIG. 13.

FIG. 17 is a sectional view which shows a portion of cover 210 and canister 208, together with a portion of container 10'. As shown in FIG. 17, cover 210 includes a main cover plate 270, which carries an O-ring 272 for sealing cover plate 270 and the inner wall of canister of 208. The clamping or locking mechanism of cover 210 includes clamps 274, clamp ring 275, dowel pins 276, bearing blocks 278 and connecting ring 280. Clamping air cylinders 222A-222D are mounted between cover plate 270 and connecting ring 280. When air cylinders 222A-222D are actuated, their pistons move upward, lifting connecting ring 280. This transfers motion through bearing blocks 278 and dowel pins 276 to cause outward motion of clamps 274 In the absence of air pressure applied to cylinders 222A-222D, bias springs within cylinders 222A-222D will to tend force connecting ring 280 back down the position shown in FIG. 17, which through dowel pins 278 will pull clamps 274 radially inward to the position shown in FIG. 17.

Fixedly mounted in the center of main cover plate 270 is dome 282, which supports sleeve 284 and key-code cone 286. O-ring 288 provides a seal between cone 286 and the inner wall of dome 282. Shoulder bolts 290 connect together sleeve 284 and cone 286 Knob 236 is attached to the upper end of sleeve 284 by bolts 292.

The relative position of sleeve 284 and cone 286 with respect to dome 282 in an axial direction is determined by the position of adjustable stop 294. Lock nut 296 holds adjustable stop 294 in position The purpose of adjustable stop 294 is to allow system 200 to accommodate manufacturing tolerances in all parts.

Sleeve 284 and cone 286 are permitted to rotate with respect to dome 282. Rotational forces apply to sleeve 284 and cone 286 by knob 236. This allows rotation of cone 286 so that key tabs 298 can be brought into alignment with the respective key slots in cap 80. As shown in FIG. 17, dowel pins 300 hold key tab 298 on the inner surface of cone 286.

Alignment pins 90 of cap 80 made with recesses 302 on the inner surface of cone 286 to assist in proper alignment of cone 286 with respect to cap 80.

Coaxially mounted within sleeve 284 is coupling 304. The upper end of coupling 304 is connected to tubing conduit 230. Connected at the lower end of coupling 304 is probe 238. O-ring 306 forms a seal between flange 308 of probe 238 and cone 286. Distal end 310 of probe 238 is pointed, and carries O-ring 312 which forms a seal with the neck region of fitment 14. Probe 238 has a T-shaped passage 314 which opens at distal end 310 and which is connected to valve chamber 316. Positioned within valve chamber 316 is a check valve formed by spring 318, disk 320 and poppet 322. Fluid passage 324 of coupling 304 connects the interior of valve chamber 316 with tubing conduit 230. Spring 318 biases poppet 322 to a normally closed position as shown in FIG. 17. When fluid pressure is present within container 10, due to air pressure being applied to pouch 12, the fluid pressure causes poppet 322 to unseat, and allows fluid flow out of pouch 12 through passage 314, valve chamber 316 and passage 324 to the tubing conduit 230.

In the embodiment shown in FIG. 17, coupling 304 and probe 238 do not rotate with knob 234, sleeve 284, and cone 286. This allows rotation to be applied to knob 236 in order to align key tabs 298 with their corresponding key slots in cap 80 without causing any rotation of probe 238.

During dispensing, air pressure is applied to the interior of canister 208, and is permitted to enter the interior of bottle 16. The passageway for air flow is through the space between cap 80 and cone 286, which is provided in part by the notches or grooves of the periphery of cap 80. Air flows through recesses 302 in cone 286 and through vent hole 88 (FIG. 8A and 8B) of cap 80. Once within cap 80, air flows through slots 54A and 54B in retainer 18 (see FIGS. 5A and 5B) and into the interior of bottle 16. Air pressure tends to collapse pouch 12, which forces fluid out through probe 238 and coupling 304. Because the same air pressure is being applied both to the outer wall and the inner wall of bottle 16, wall strength of bottle 16 is not a factor in the ability to dispense fluid under pressure.

4. Conclusion

The present invention provides an important alternative to prior art systems for handling and shipping liquid chemicals. The present invention provides a low cost, rugged, container which simplifies the disposal of parts coming into contact with the chemicals. In addition, the present invention is well suited for manual and automated dispensing in a safe manner which avoids any contact of the contents of the container with personnel and with the atmosphere.

Although the present invention has been described with reference to preferred embodiments, workers skilled in the art will recognize that changes may be made in form and detail without departing from the spirit and scope of the invention.

What is claimed is:

1. A double containment container for liquid chemicals, the container comprising:

a sealed flexible film pouch having an interior for holding liquid;

a fitment sealed to the pouch and defining a port which communicates with the interior of the pouch;

rupturable seal means for sealing the port after the pouch has been filled with liquid through the port;

a bottle having a mouth which communicates with an interior of the bottle;

retaining means for engaging the fitment and the mouth of the bottle to position the fitment in the mouth with the pouch within the interior of the bottle; and a cap which engages the mouth of the bottle and is positioned over the mouth of the bottle and the fitment.

2. The container of claim 1 wherein the pouch is a fluoropolymer material.

3. The container of claim 2 wherein the fitment is a fluoropolymer material.

4. The container of claim 3 wherein the rupturable seal means is a fluoropolymer membrane.

5. The container of claim 2 wherein the bottle is a polyethylene material.

6. The container of claim 1 wherein the cap has a central main port generally aligned with the port of the fitment.

7. The container of claim 6 wherein the cap further comprises:

removable seal means covering the central main port.

8. The container of claim 1 wherein the pouch is formed by an integral film folded at an upper end to form first and second opposing sheets and having an opening in the upper end, the first and second sheets being sealed to one another along side and bottom edges and being sealed to the fitment around the opening in the upper end.

9. The container of claim 1 and wherein the retaining means and the cap have vent passages for permitting air to enter the interior of the bottle around the pouch as liquid is dispensed from the pouch.

10. The container of claim 9 and further comprising:

means for removably covering the vent passage in the cap.

11. The container of claim 10 wherein the removable seal means includes an integral pull tab.

12. The container of claim 11 wherein the pull tab includes means for engaging the means for removably covering the vent passage in the cap to cause the vent passage to be opened.

13. The container of claim 1 wherein the fitment comprises:

a mouth portion;

a neck portion connected to the mouth portion; and a shoulder flange portion connected to the neck portion and sealed to the pouch.

14. The container of claim 13 wherein the shoulder flange portion is generally conical.

15. The container of claim 13 wherein the rupturable seal means is a membrane which covers the mouth of the fitment.

16. A container for liquid chemicals, the container comprising:

a sealed flexible film pouch having an interior for holding liquid;

a fitment sealed to the pouch and defining a port which communicates with the interior of the pouch;

a rupturable seal means for sealing the port;

a bottle having a mouth which communicates with an interior of the bottle;

retaining means for engaging the fitment and the mouth of the bottle to position the fitment in the mouth with the pouch within the interior of the bottle; and wherein the retaining means comprises: first and second retainer segments; and hinge means connecting the segments.

17. The container of claim 16 wherein the fitment has a flange adjacent its outer end, and the retainer segments engage the flange.

18. A liquid chemical handling system comprising:

a container which comprises:

a sealed flexible film pouch having an interior for holding liquid;

a fitment sealed to the pouch and defining a port which communicates with the interior of the pouch;

rupturable seal means for sealing the port;

a bottle having a mouth which communicates with an interior of the bottle; and retaining means for engaging the fitment and the mouth of the bottle to position the fitment in the mouth with the pouch within the interior of the bottle; and a dispenser which comprises:

a probe insertable through the rupturable seal means and into the port, the probe having a flow passage therein; and means connected to the probe for receiving liquid chemical dispensed from the pouch through the flow passage;

seal means for providing a seal between the probe and the port;

valve means for controlling flow through the flow passage, wherein the valve means is a normally closed check valve; and receptacle means for holding the bottle in an inverted position, wherein the receptacle means include a projection for opening the check valve when an outer end of the probe is in the receptacle means.

19. A liquid chemical handling system comprising:

a container which comprises:

a sealed flexible film pouch having an interior for holding liquid;

a fitment sealed to the pouch and defining a port which communicates with the interior of the pouch;

rupturable seal means for sealing the port;

a bottle having a mouth which communicates with an interior of the bottle; and retaining means for engaging the fitment and the mouth of the bottle to position the fitment in the mouth with the pouch within the interior of the bottle; and a cap which engages the mouth of the bottle and is positioned over the mouth of the bottle and the fitment; and a dispenser which comprises:

a probe insertable through the rupturable seal means and into the port, the probe having a flow passage therein; and means connected to the probe for receiving liquid chemical dispensed from the pouch through the flow passage.

20. The system of claim 19 wherein the dispenser further comprises:

seal means for providing a seal between the probe and the port.

21. The system of claim 20 wherein the dispenser further comprises:

valve means for controlling flow through the flow passage.

22. The system of claim 21 wherein the valve means is a normally closed check valve.

23. The system of claim 22 wherein the dispenser further comprises:

receptacle means for holding the bottle and the probe in an inverted position.

24. The system of claim 19 wherein the dispenser further comprises:

cap engaging means associated with the probe for engaging the cap while the probe is inserted through the cap and the rupturable seal means and into the port.

25. A liquid chemical handling system comprising:

a container which comprises:

a sealed flexible film pouch having an interior for holding liquid;

a fitment sealed to the pouch and defining a port which communicates with the interior of the pouch;

rupturable seal means for sealing the port;

a bottle having amount which communicates with an interior of the bottle; and retaining means for engaging the fitment and the mouth of the bottle to position the fitment in the mouth with the pouch within the interior of the bottle; and a dispenser which comprises:

a probe insertable through the rupturable seal means and into the port, the probe having a flow passage therein; and means connected to the probe for receiving liquid chemical dispensed from the pouch through the flow passage; and means for supplying fluid under pressure between inner walls of the bottle and the pouch to force liquid out of the pouch through the flow passage in the probe.

26. A liquid chemical handling system comprising:

a container which comprises:

a sealed flexible film pouch having an interior for holding liquid;

a fitment sealed to the pouch and defining a port which communicates with the interior of the pouch;

rupturable seal means for sealing the port;

a bottle having a mouth which communicates with an interior of the bottle; and retaining means for engaging the fitment and the mouth of the bottle to position the fitment in the mouth with the pouch within the interior of the bottle; and a dispenser which comprises:

a probe insertable through the rupturable seal means and into the port, the probe having a flow passage therein;

means connected to the probe for receiving liquid chemical dispensed from the pouch through the flow passage;

means for supplying fluid under pressure between inner walls of the bottle and the pouch to force liquid out of the pouch through the flow passage in the probe;

a pressure vessel having an interior chamber for holding the container; and wherein the means for supplying fluid supplies the fluid under pressure to the interior chamber of the pressure vessel.

27. The system of claim 26 wherein the pressure vessel includes a canister and a cover, and wherein the probe is carried by the cover.

28. The system of claim 27 wherein the dispenser further comprises:

means for locking the cover on the canister in a closed position;

means for moving the cover between an open position and the closed position; and means for controlling the means for locking and the means for moving.

29. The system of claim 28 wherein the means for moving comprises:

means for lifting the cover; and means for tilting the cover.

30. The system of claim 26 wherein the dispenser further comprises:

means for inverting the pressure vessel.

31. For use with a liquid chemical container having a sealed film pouch within a generally rigid bottle with a port which provides access to an interior of the pouch and a rupturable seal over the port, a dispenser comprising:

a pressure vessel having an interior chamber for holding the container;

a rupturable seal piercing probe associated with the pressure vessel for insertion into the port when the container is in the chamber, the probe having a flow passage therein; and means for supplying fluid under pressure to the interior chamber and between inner walls of the bottle and the pouch to force liquid out of the pouch through the flow passage in the probe.

32. The dispenser of claim 31 and further comprising:

seal means for providing a seal between the probe and the port.

33. The dispenser of claim 31 and further comprising:

valve means for controlling flow through the flow passage.

34. The dispenser of claim 31 wherein the container is of a type having a cap positioned over a mouth of the bottle, and wherein the dispenser further comprises:

cap engaging means associated with the probe for engaging the cap while the probe is inserted through the cap and into the port.

35. The dispenser of claim 31 and further comprising:
means for inverting the pressure vessel so that the port and the probe are at the bottom of the bottle.

36. The dispenser of claim 31 wherein the pressure vessel includes a canister and a cover, and wherein the probe is carried by the cover.

37. For use with a liquid chemical container having a sealed film pouch within a generally rigid bottle with a port which provides access to an interior of the pouch, a dispenser comprising:
a pressure vessel having an interior chamber for holding the container;
a probe associated with the pressure vessel for insertion into the port when the container is in the chamber, the probe having a flow passage therein;
means for supplying fluid under pressure to the interior chamber and between inner walls of the bottle and the pouch to force liquid out of the pouch through the flow passage in the probe;
means for inverting the pressure vessel so that the port and the probe are at the bottom of the bottle;
a housing;
a drawer slidably connected to the housing and movable between an open and a closed position; and
means for pivotally mounting the pressure vessel with respect to the drawer.

38. The dispenser of claim 37 wherein the means for inverting the pressure vessel is responsive to movement of the drawer to move the pressure vessel from a generally upright position when the drawer is in its open position to an inverted position when the drawer is in its closed position.

39. For use with a liquid chemical container having a sealed film pouch within a generally rigid bottle with a port which provides access to an interior of the pouch, a dispenser comprising:
a pressure vessel having a canister, a cover and an interior chamber for holding the container;
a probe carried by the cover for insertion into the port when the container is in the chamber; the probe having a flow passage therein;
means for supplying fluid under pressure to the interior chamber and between inner walls of the bottle and the pouch to force liquid out of the pouch through the flow passage in the probe;
means for locking the cover on the canister in a closed position;
means for moving the cover between an open position and the closed position; and
means for controlling the means for locking and the means for moving.

40. The system of claim 39 wherein the means for moving comprises:
means for lifting the cover; and
means for tilting the cover.

41. A method of handling liquid chemicals, the method comprising:
providing a sealed flexible film pouch having an interior for holding liquid and having a fitment sealed thereto, the fitment defining a port which communicates with the interior of the pouch;
positioning a retainer around the fitment;
placing the pouch within an interior of a bottle, by insertion through a mouth of the bottle, the retainer engaging the mouth of the bottle to hold the fitment in position within the mouth of the bottle;
filling the interior of the pouch through the port;
placing a rupturable membrane over an outer end of the fitment, after filling the interior of the pouch, to seal the port; and
placing a cap over the mouth of the bottle to cover the rupturable seal.

42. The method of claim 41 and further comprising:
inserting a probe through the membrane and into the port, the probe having a flow passage therein; and
dispensing liquid from the pouch through the flow passage of the port.

43. The method of claim 42 wherein the probe includes an O-ring for sealing the probe and the port.

44. The method of claim 43 wherein the probe includes a check valve in the flow passage.

45. The method of claim 41 and further comprising:
opening the seal of the port; and
dispensing liquid from the pouch through the port.

46. The method of claim 45 and further comprising:
removing the pouch from the bottle when the pouch has been emptied by engaging the retainer and pulling the retainer, the fitment and the pouch out of the bottle through the mouth.

47. The method of claim 41 and further comprising:
opening a passage through the cap to permit the probe to extend therethrough and into the port.

48. The method of claim 47 wherein the probe is carried by a carrier, and wherein inserting the probe includes engaging the cap with the carrier.

49. A method of handling liquid chemicals in a double containment system, the method comprising:
providing a sealed flexible film pouch having an interior for holding liquid and having a fitment sealed thereto, the fitment defining a port which communicates with the interior of the pouch;
placing the pouch within an interior of a bottle by insertion through a mouth of the bottle, with the fitment held within the mouth of the bottle;
filling the interior of the pouch through the port;
placing a rupturable membrane over the fitment to seal the port;
inserting a probe through the membrane and into the port, the probe having a flow passage therein;
inverting the probe and the bottle together; and
inserting an outer end of the probe into a receptacle to hold the bottle and probe in inverted position; and
dispensing liquid from the pouch through the flow passage of the port.

50. The method of claim 49 wherein the receptacle includes an outlet port which is connected to the flow passage of the probe when the outer end of the probe is positioned in the receptacle.

51. The method of claim 50 wherein the probe includes a normally closed check valve at its outer end for closing the flow passage and wherein the receptacle includes a projection for opening the check valve when the outer end of the probe is in the receptacle.

52. A method of handling liquid chemicals in a double containment system, the method comprising:
providing a sealed flexible film pouch having an interior for holding liquid and having a fitment sealed thereto, the fitment defining a port which communicates with the interior of the pouch;
placing the pouch within an interior of a bottle by insertion through a mouth of the bottle, with the fitment held within the mouth of the bottle;
filling the interior of the pouch through the port;
sealing the port;

opening the seal of the port; and supplying fluid under pressure between inner walls of the bottle and the pouch to force liquid out of the pouch.

53. A method of handling liquid chemicals, the method comprising:

providing a sealed flexible film pouch having an interior for holding liquid and having a fitment sealed thereto, the fitment defining a port which communicates with the interior pouch;

placing the pouch within an interior of a bottle, with the fitment held within a mouth of the bottle;

filling the interior of the pouch through the port;

sealing the port;

placing the bottle within a pressure vessel;

opening the seal of the port;

supplying fluid under pressure between inner walls of the bottle and the pouch to force liquid out of the pouch; and supplying fluid under pressure within the pressure vessel so that a pressure gradient across walls of the bottle is minimized.

54. A double containment container for liquid chemicals, the container comprising:

a sealed flexible film pouch having an interior for holding liquid;

a fitment sealed to the pouch and defining a port which communicates with the interior of the pouch;

rupturable seal means for sealing the port after the pouch has been filled with liquid through the port;

a bottle having a mouth which communicates with an interior of the bottle;

retaining means for engaging the fitment and the mouth of the bottle to position the fitment in the mouth with the pouch within the interior of the bottle;

a cap which engages the mouth of the bottle and is positioned over the mouth of the bottle and the fitment, the cap having a central main port generally aligned with the port of the fitment; and vent means for permitting air to pass through the retaining means and the cap in order to enter the interior of the bottle around the pouch as liquid is dispensed from the pouch.

55. The container of claim 54, wherein the fitment comprises:

a mouth portion;

a neck portion connected to the mouth portion; and a shoulder flange portion connected to the neck portion and sealed to the pouch.

56. The container of claim 55, wherein the rupturable seal means contact the mouth portion of the fitment.

57. The container of claim 56, and further comprising:

means in the cap for removably covering the vent means.

58. The container of claim 57, and further comprising:

removable seal means for covering the central port.

59. The container of claim 58, wherein the removable seal means include an integral pull tab, the integral pull tab including means for engaging the means in the cap for removably covering the vent passage to cause the vent means to be opened.

60. A double containment container for liquid chemicals, comprising:

a flexible film pouch having an interior for holding liquid;

a fitment sealed to the pouch and defining a port which communicates with the interior of the pouch;

a bottle having an interior and a mouth which communicates with the interior of the bottle;

retaining means for engaging the fitment and the mouth of the bottle to position the fitment in the mouth of the bottle when the pouch is within the interior of the bottle;

a cap for sealably engaging the mouth of the bottle and for being positioned over the mouth of the bottle and the fitment; and a seal, coupled to the cap, for sealing the port when the cap sealably engages the bottle.

61. The container of claim 60 wherein the pouch is a fluoropolymer material.

62. The container of claim 61 wherein the fitment is a fluoropolymer materials.

63. The container of claim 62 wherein the seal is a fluoropolymer material.

64. The container of claim 61 wherein the bottle is a polyethylene material.

65. The container of claim 60 wherein the retaining means has at least one vent passage for permitting air to enter the interior of the bottle around the pouch as liquid is dispensed from the pouch.

66. The container of claim 65 wherein the retaining means comprises:

first and second retainer segments; and a hinge for connecting the first and second retainer segments.

67. The container of claim 66 wherein the fitment has a flange adjacent its outer end, and the retainer segments engage the flange.

68. The container of claim 60 wherein the fitment comprises:

a mouth portion;

a neck portion connected to the mouth portion; and a shoulder flange portion connected to the neck portion and sealed to the pouch.

69. The container of claim 68 wherein the fitment further comprises:

a seal abutment coupling the neck portion to the shoulder flange portion.

70. The container of claim 69 wherein the seal abuts the seal abutment in the fitment when the cap is sealably engaged with the bottle.

71. The container of claim 70 wherein the pouch is formed by an integral film folded at an upper end to form first and second opposing sheets and having an opening at the upper end, the first and second sheets being sealed to one another along side and bottom edges and being sealed to the fitment around the opening in the upper end.

72. The container of claim 68 wherein the shoulder flange portion is generally conical.

* * * * *